US012006620B2

(12) United States Patent
Fu et al.

(10) Patent No.: US 12,006,620 B2
(45) Date of Patent: Jun. 11, 2024

(54) DISPENSING DEVICE, DISPENSING ASSEMBLY, AND WASHING DEVICE HAVING THE SAME

(71) Applicant: Wuxi Little Swan Electric Co., Ltd., Wuxi (CN)

(72) Inventors: Shibo Fu, Wuxi (CN); Shulin Yan, Wuxi (CN); Guangan Yu, Wuxi (CN)

(73) Assignee: WUXI LITTLE SWAN ELECTRIC CO., LTD., Wuxi (CN)

( * ) Notice: Subject to any disclaimer, the term of this patent is extended or adjusted under 35 U.S.C. 154(b) by 0 days.

(21) Appl. No.: 18/284,378

(22) PCT Filed: Apr. 29, 2022

(86) PCT No.: PCT/CN2022/090791
§ 371 (c)(1),
(2) Date: Sep. 27, 2023

(87) PCT Pub. No.: WO2022/228575
PCT Pub. Date: Nov. 3, 2022

(65) Prior Publication Data

US 2024/0084497 A1 Mar. 14, 2024

(30) Foreign Application Priority Data

Apr. 30, 2021 (CN) ..... 202110485785.6

(51) Int. Cl.
*D06F 39/02* (2006.01)

(52) U.S. Cl.
CPC ..... *D06F 39/022* (2013.01)

(58) Field of Classification Search
CPC ..... D06F 39/022
(Continued)

(56) References Cited

U.S. PATENT DOCUMENTS

2015/0075230 A1 3/2015 Ban et al.

FOREIGN PATENT DOCUMENTS

CN 109322110 A 2/2019
CN 110016789 A 7/2019
(Continued)

OTHER PUBLICATIONS

CN112301671A—machine translation (Year: 2021).*
(Continued)

*Primary Examiner* — Tinsae B Ayalew
(74) *Attorney, Agent, or Firm* — Anova Law Group, PLLC

(57) ABSTRACT

A dispensing device includes a dispensing pump, a drive assembly, and a one-way transmission mechanism. The dispensing pump includes a pump housing having a liquid inlet and a liquid outlet, and a pump body. The drive assembly includes a driver movable between a first position and a second position. The one-way transmission mechanism is located between the drive assembly and the pump body. During movement of the driver from the first position to the second position, the drive assembly drives the one-way transmission mechanism to move, and the one-way transmission mechanism drives the pump body to move, to suck detergent through the liquid inlet and discharge the detergent through the liquid outlet. During movement of the driver from the second position to the first position, the drive assembly drives the one-way transmission mechanism to move, and the one-way transmission mechanism does not drive the pump body to move.

18 Claims, 13 Drawing Sheets

(58) Field of Classification Search
USPC ..... 68/3 R
See application file for complete search history.

(56) References Cited

FOREIGN PATENT DOCUMENTS

| | | | |
|---|---|---|---|
| CN | 112301671 | A | 2/2021 |
| CN | 114263027 | A | 4/2022 |

OTHER PUBLICATIONS

The World Intellectual Property Organization (WIPO) International Search Report and Written opinion for PCT/CN2022/090791 dated Sep. 14, 2022 14 pages (including English translation).

* cited by examiner

DISPENSING DEVICE, DISPENSING ASSEMBLY, AND WASHING DEVICE HAVING THE SAME

CROSS-REFERENCE TO RELATED APPLICATIONS

The present application is a National Stage Entry under 35 U.S.C. § 371 of International Application No. PCT/CN2022/090791, filed on Apr. 29, 2022, which claims priority to Chinese Patent Application No. 202110485785.6, entitled "DISPENSING DEVICE, DISPENSING ASSEMBLY, AND WASHING DEVICE HAVING THE SAME," filed with China National Intellectual Property Administration on Apr. 30, 2021 by WUXI LITTLE SWAN ELECTRIC CO., LTD, the entire disclosures of both of which are incorporated herein by reference.

FIELD

The present disclosure relates to the technical field of detergent dispensing, and in particular, to a dispensing device, a dispensing assembly, and a washing device having the same.

BACKGROUND

With the change in consumption habits and upgrading of consumption, liquid detergent such as laundry detergent or fabric softener has a higher and higher utilization rate. In addition, compared with manually dispensing the laundry detergent into a washing machine at every time of washing, which may be troublesome and difficult to control a usage amount, a washing machine with an automatic dispensing function is becoming more popular. However, the automatic dispensing function is costly and usually only available on a high-end washing machine. Therefore, a manually operated semi-automatic dispensing device has been proposed to eliminate the manual dispensing of the detergent from a container by a user every time. By setting an amount of the detergent to be manually dispensed each time, a precise dispensing amount can be realized by controlling a number of times of driving the device by the user himself/herself, allowing for easy washing for the user. In addition, the user can decide a total dispending amount of the detergent based on a cleanliness degree and a material of the laundry. However, in the related art, after operations such as pressing are performed manually, a manual dispensing device is prone to occurring reverse suction of the detergent, making it difficult to ensure accuracy of detergent dispensing.

SUMMARY

The present disclosure aims to solve one of the technical problems in the related art to some extent.

To this end, the present disclosure provides a dispensing device. By providing a one-way transmission mechanism, it is beneficial to avoid reverse suction of a dispensing pump to detergent through a liquid outlet to ensure accuracy of detergent dispensing.

The present disclosure further provides a dispensing assembly having the dispensing device as described above.

The present disclosure further provides a washing device having the dispensing assembly as described above.

According to an embodiment of the present disclosure, a dispensing device for dispensing detergent is provided. The dispensing device includes a dispensing pump, a drive assembly, and a one-way transmission mechanism. The dispensing pump includes a pump housing and a pump body, and the pump housing has a liquid inlet and a liquid outlet. The drive assembly includes a driver movable between a first position and a second position. The one-way transmission mechanism is located between the drive assembly and the pump body. During a movement of the driver from the first position to the second position, the drive assembly drives the one-way transmission mechanism to move, and the one-way transmission mechanism drives the pump body to move, allowing the detergent to be sucked through the liquid inlet and discharged through the liquid outlet. During a movement of the driver from the second position to the first position, the drive assembly drives the one-way transmission mechanism to move, and the one-way transmission mechanism does not drive the pump body to move.

In the dispensing device according to the embodiments of the present disclosure, by providing the one-way transmission mechanism, during the movement of the driver from the second position to the first position, the drive assembly drives the one-way transmission mechanism to move, and the one-way transmission mechanism does not drive the pump body to move, which can prevent the dispensing pump from reversely sucking the detergent through the liquid outlet to ensure the accuracy of the detergent dispensing. Meanwhile, during the movement of the driver from the second position to the first position, since the one-way transmission mechanism does not drive the pump body to move, it is helpful to reduce resistance at which the driver moves from the second position to the first position and enhance user's operation experience.

Additional aspects and advantages of the present disclosure will be partially set forth in the following description and partially become apparent from the following description, or they may be learned through practice of the present disclosure.

DETAILED DESCRIPTION

Figure 1:
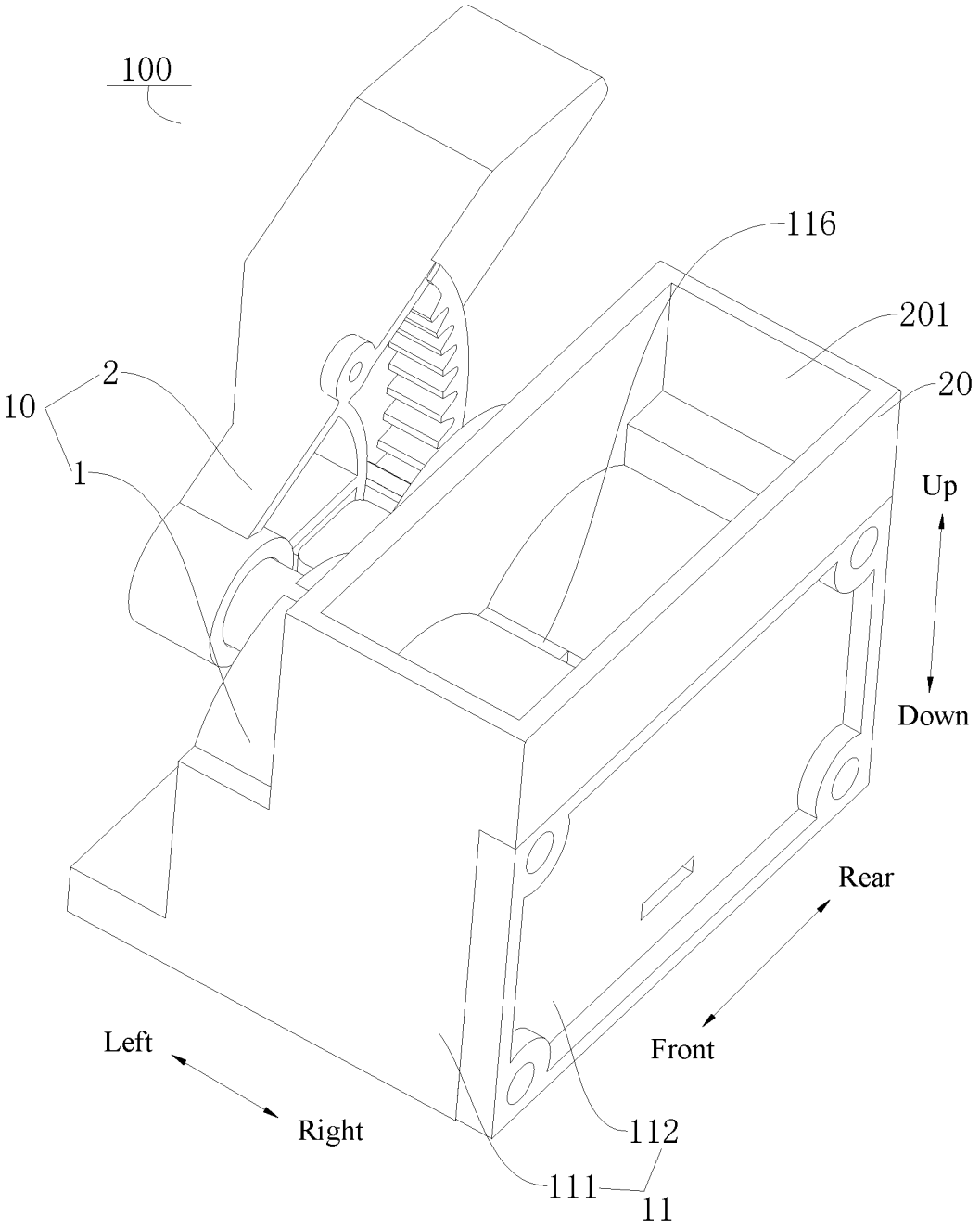
FIG. 1 is a perspective view of a dispensing assembly according to an embodiment of the present disclosure.

Embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the drawings are illustrative only, and are intended to explain, rather than limiting, the present disclosure.

A dispensing device 10, a dispensing assembly 100, and a washing device 1000 according to embodiments of the present disclosure will be described below with reference to the drawings. For example, the dispensing device 10 may be applied in a washing device having a water inlet system such as a washing machine, a dishwasher, a wash basin, or a sink.

Figure 2:
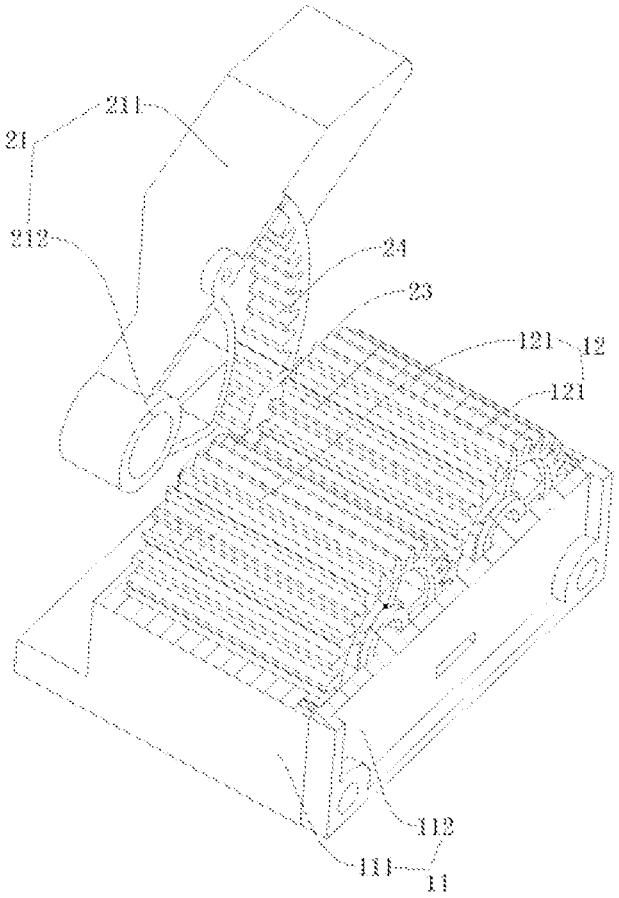
FIG. 2 is a perspective view of a partial structure of a dispensing device shown in FIG. 1.

As illustrated in FIG. 1 and FIG. 2, according to the embodiments of the present disclosure, the dispensing device 10 is used for dispensing detergent, and may include a dispensing pump 1, a drive assembly 2, and a one-way transmission mechanism 3. The detergent may be liquid detergent such as laundry detergent and a softener.

Figure 3:
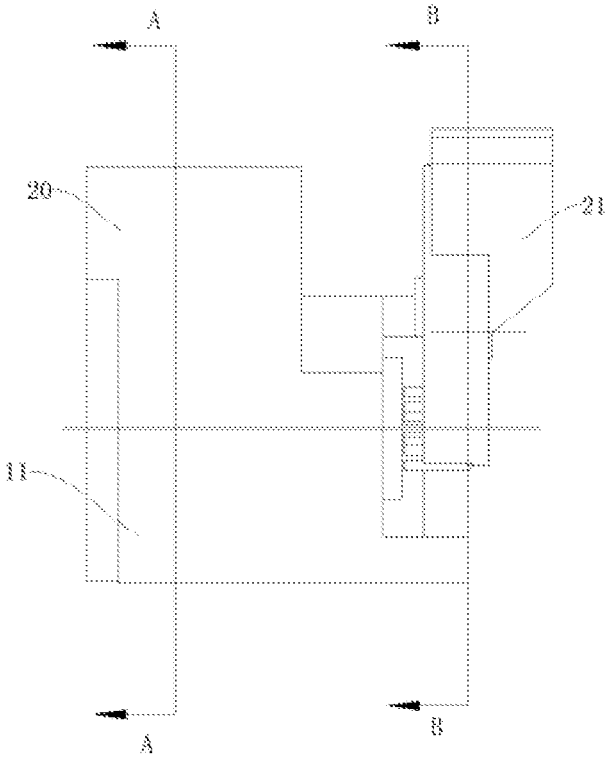
FIG. 3 is a front view of the dispensing assembly shown in FIG. 1.
Figure 4:
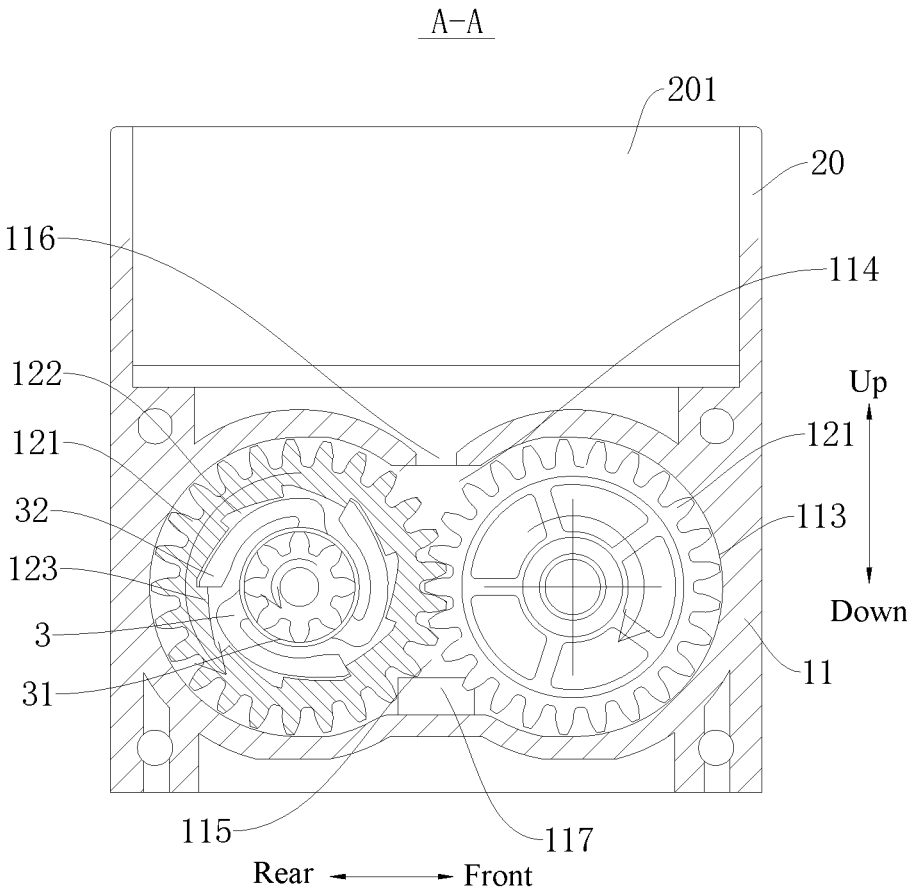
FIG. 4 is a cross-sectional view taken along line A-A in FIG. 3.

Referring to FIG. 1, FIG. 3, and FIG. 4, the dispensing pump 1 includes a pump housing 11 and a pump body 12. The pump housing 11 has a liquid inlet 116 and a liquid outlet 117. The drive assembly 2 includes a driver 21. For example, referring to FIG. 1 and FIG. 2, the driver 21 is disposed at an outer side of the pump housing 11. It can be understood that by arranging the driver 21 at the outer side of the pump housing 11, it is possible to allow a movement space of the driver 21 not to be limited by a dimension of the pump housing 11, which allows for an increased movement travel of the driver 21. Further, an amount of a single dispensing of the dispensing device 10 can be increased. Accordingly, it is beneficial to reduce a number of dispensing times, which is suitable for demands of a high-capacity washing device such as a washing machine and a dishwasher for the detergent dispensing. Therefore, user's usage experience can be enhanced.

Figure 5:
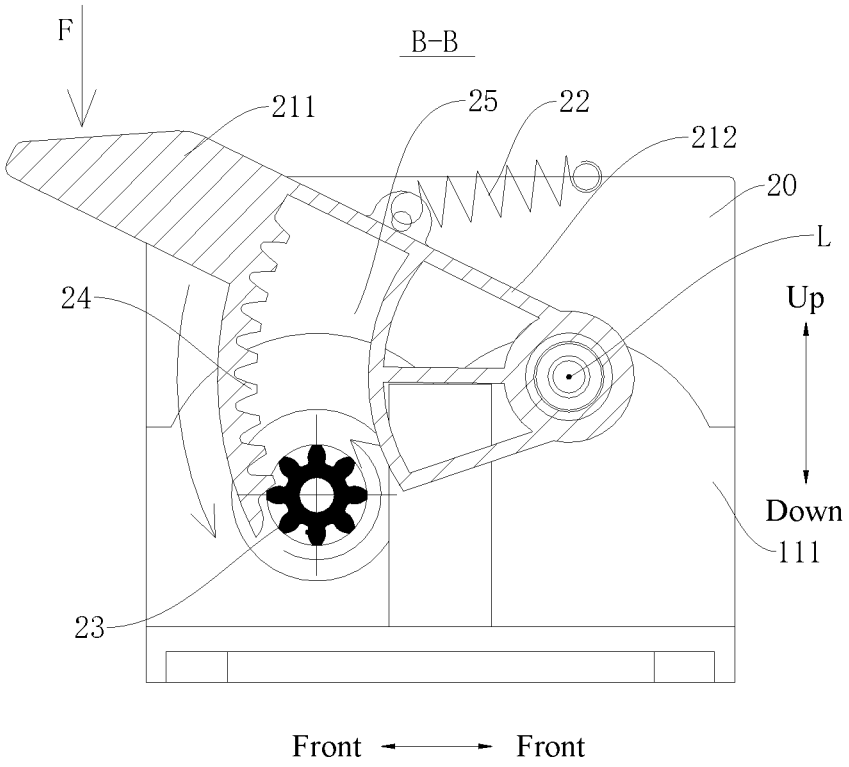
FIG. 5 is a cross-sectional view taken along line B-B in FIG. 3.
Figure 6:
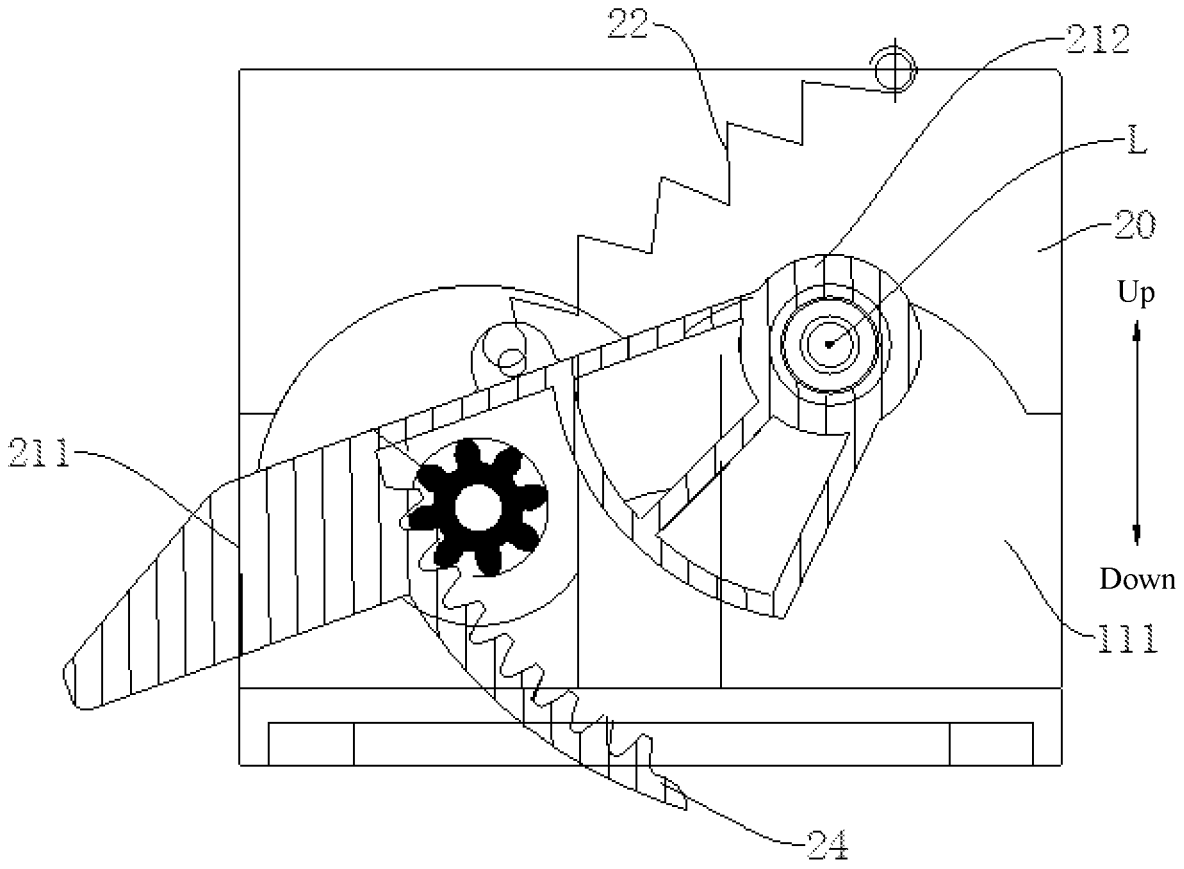
FIG. 6 is a schematic cross-sectional view of the dispensing assembly shown in FIG. 1, in which a driver is in a second position.

Referring to FIG. 1, FIG. 3, and FIG. 4, the driver 21 is movable between a first position shown in FIG. 5 and a second position shown in FIG. 6, and the one-way transmission mechanism 3 is located between the drive assembly 2 and the pump body 12. During a movement of the driver 21 from the first position to the second position, the drive assembly 2 drives the one-way transmission mechanism 3 to move, and the one-way transmission mechanism 3 then drives the pump body 12 to move, allowing the detergent to be sucked through the liquid inlet 116 and discharged through the liquid outlet 117. During a movement of the driver 21 from the second position to the first position, the drive assembly 2 drives the one-way transmission mechanism 3 to move, and the one-way transmission mechanism 3 does not drive the pump body 12 to move. That is, during the movement of the driver 21 from the second position to the first position, the one-way transmission mechanism 3 is not in a transmission engagement with the pump body 12.

For example, with reference to FIG. 5 and FIG. 6, a user may manually drive the driver 21 to move from the first position to the second position, and the one-way transmission mechanism 3 drives the pump body 12 to move. In this way, the detergent can be sucked through the liquid inlet 116 and discharged through the liquid outlet 117, to achieve semi-automatic dispensing of the dispensing device 10. That is, the detergent is dispensed manually. In addition, when the user manually drives the driver 21 to move from the second position to the first position, the drive assembly 2 drives the one-way transmission mechanism 3 to move, and the one-way transmission mechanism 3 is not in the transmission engagement with the pump body 12 and does not drive the pump body 12 to move. It can be understood that by arranging the one-way transmission mechanism 3, during the movement of the driver 21 from the second position to the first position, the drive assembly 2 drives the one-way transmission mechanism 3 to move, and the one-way transmission mechanism 3 does not drive the pump body 12 to move. Therefore, it is beneficial to prevent the dispensing pump 1 to reversely sucking the detergent through the liquid outlet 117 to ensure accuracy of detergent dispensing. Meanwhile, during the movement of the driver 21 from the second position to the first position, since the one-way transmission mechanism 3 does not drive the pump body 12 to move, the resistance at which the driver 21 moves from the second position to the first position can be reduced. Therefore, a user's operation experience can be enhanced.

In view of this, according to the dispensing device 10 in the embodiments of the present disclosure, by providing the one-way transmission mechanism 3, during the movement of the driver 21 from the second position to the first position, the drive assembly 2 drives the one-way transmission mechanism 3 to move, and the one-way transmission mechanism 3 does not drive the pump body 12 to move. In this way, it is possible to prevent the dispensing pump 1 from reversely sucking the detergent through the liquid outlet 117, and thus accuracy of the detergent dispensing is high. Meanwhile, during the movement of the driver 21 from the second position to the first position, since the one-way transmission mechanism 3 does not drive the pump body 12 to move, the resistance at which the driver 21 moves from the second position to the first position can be reduced. Therefore, the user's operation experience can be enhanced.

In some embodiments of the present disclosure, referring to FIG. 4, the pump body is rotatably disposed in the pump housing 11 to form a liquid sucking region 114 and a liquid discharge region 115 in the pump housing 11. The liquid inlet 116 corresponds to the liquid sucking region 114, and the liquid outlet 117 corresponds to the liquid discharge region 115. For example, when the dispensing device 10 is in an initial state (with no detergent in the liquid discharge region 115), and when the user drives the driver 21 to rotate from the first position to the second position, the one-way transmission mechanism 3 drives the pump body 12 to move, which can create a negative pressure in the liquid sucking region 114 and a positive pressure in the liquid discharge region 115. The detergent at the liquid inlet 116 can flow towards the liquid discharge region 115 with a pressure difference. During this process, liquid suction at the liquid inlet 116 and liquid discharge at the liquid outlet 117 of the dispensing pump 1 are not synchronously implemented until the detergent is discharged through the liquid outlet 117. Thereafter, during normal operation of the dispensing device 10, when the driver 21 is rotated to dispense the detergent, the liquid suction at the liquid inlet 116 and the liquid discharge at the liquid outlet 117 of the dispensing pump 1 are synchronously implemented.

It should be noted that it has been found in practical research that in a manual dispensing device in the related art, the liquid suction and the liquid discharge are realized through a reciprocation device for changing a volume ratio of a suction cavity and a discharge cavity, such as a plunger pump. In addition, a liquid suction action and a liquid discharge action are alternately performed. In other words, the liquid suction and the liquid discharge of the manual dispensing device in the related art are located in one region, and are not synchronously implemented. Further, a liquid discharge force is provided by manual pressing, and power required for liquid suction is provided by spring restoration, which is similar to a pressing and dispensing device used for shampoo or liquid hand soap in daily life. However, since the washing device such as a washing machine or a dishwasher has a large volume, a demand for the detergent each wash is far greater than a single usage amount of the liquid hand soap or shampoo in daily life. As a result, it is necessary to increase a dimension of the pump cavity or a number of times of user's pressing, both of which would result in poor user experience.

With the dispensing device 10 according to the embodiments of the present disclosure, a rotation travel of the driver 21 from the first position to the second position is related to a rotation angle of the pump body 12, and quantitative control on the detergent dispensing amount can be achieved by controlling the movement travel of the driver 21. In addition, as the liquid sucking region 114 and the liquid discharge region 115 of the dispensing pump 1 are located in different regions, when the dispensing device 10 operates normally, the liquid suction at the liquid inlet 116 and the liquid discharge at the liquid outlet 117 of the dispensing pump 1 are synchronously implemented, which allows a dispensing amount of the dispensing pump 1 not to be limited by its own volume. Therefore, it is beneficial to increase an amount of the detergent to be dispensed in a single operation of the dispensing device 10. In addition, with a predetermined volume of the dispensing device 10, it is possible to increase the amount of the single dispensing of the dispensing device 10 and ensure dispensing precision of the single dispensing. As a result, the number of dispensing times can be lowered, and precision requirements can be ensure. Therefore, it is possible to meet the requirement for the detergent dispensing to the washing device 1000 with a high capacity such as a washing machine or a dishwasher. Therefore, the user's usage experience can be enhanced.

In some examples, referring to FIG. 1 and FIG. 2, the pump housing 11 includes a housing member 111 and an end cover 112. The end cover 112 is detachably disposed at an open end of the housing member 111. As shown in FIG. 4, a pump chamber 113 is formed between the housing member 111 and the end cover 112 in a relatively sealing manner. The pump body 12 is rotatably disposed in the pump chamber 113. It can be understood that by detachably arranging the end cover 112 at the open end of the housing member 111, it is possible to facilitate mounting and replacement of the pump body 12. For example, the end cover 112 may be connected to the housing member 111 through snap-fit, riveting, or by a threaded fastener, for example.

In some embodiments of the present disclosure, referring to FIG. 2 and FIG. 5, a rotation axis of the driver 21 extends substantially in a horizontal direction, and the first position is located above the second position. For example, as illustrated in FIG. 3 and FIG. 4, the rotation axis of the driver 21 is denoted as L and extends in a left-right direction. It can be understood that a trajectory of the rotation of the driver 21 about the rotation axis is an arc. By setting the first position to be above the second position, the user can press the driver 21 to rotate from the first position to the second position, which facilitates application of a force by the user to drive the dispensing device 10 to dispense the detergent. As a result, it is beneficial to enhance the user's usage experience. However, the present disclosure is not limited in this regard, and the first position may also be below the second position.

In some embodiments of the present disclosure, referring to FIG. 5 and FIG. 6, an angle between the first position and the second position is smaller than or equal to 120°. In other words, an angle between a line for connecting the first position and a rotation center of the driver 21 and a line for connecting the second position and the rotation center of the driver 21 is smaller than or equal to 120°. That is, an angle of the rotation of the driver 21 from the first position to the second position or an angle of the rotation of the driver 21 from the second position to the first position is smaller than or equal to 120°. Therefore, the angle between the first position and the second position are not excessively great. In this way, on one hand, it is possible to avoid excessive rotation travel of the driver 21, and on the other hand, interference between the driver 21 and other components can be avoided. Therefore, operation reliability of the driver 21 can be ensured. For example, as illustrated in FIG. 5 and FIG. 6, the first position is above the second position, and the user presses a free end of the driver 21 downwards to allow the driver 21 to rotate counterclockwise about the rotation axis L from the first position to the second position. In this process, the rotation trajectory of the driver 21 is an arc.

Further, the angle of the rotation of the driver 21 from the first position to the second position may be 10°, 20°, 30°, 40°, 50°, 60°, 70°, 80°, 90°, 100°, 110°, 120°, or the like. The angle of the rotation of the driver 21 from the first position to the second position may be adjusted and designed as desired, which is not limited in the present disclosure.

Figure 8:
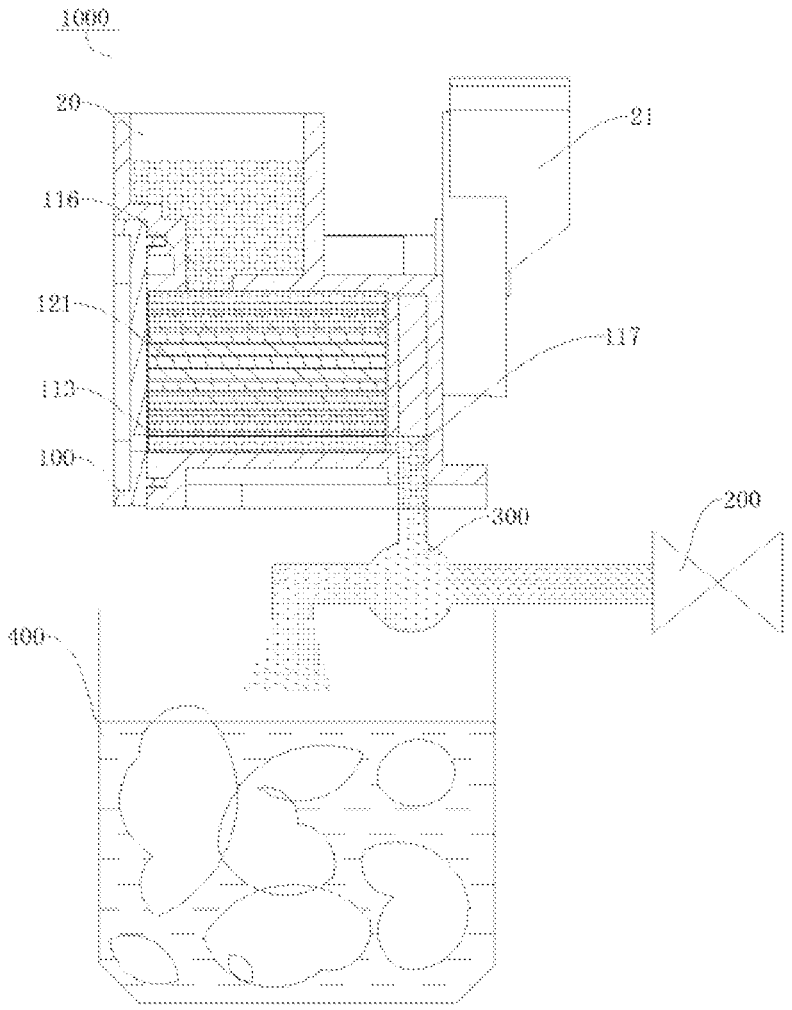
FIG. 8 is a schematic structural view of a washing device according to an embodiment of the present disclosure.
Figure 11:
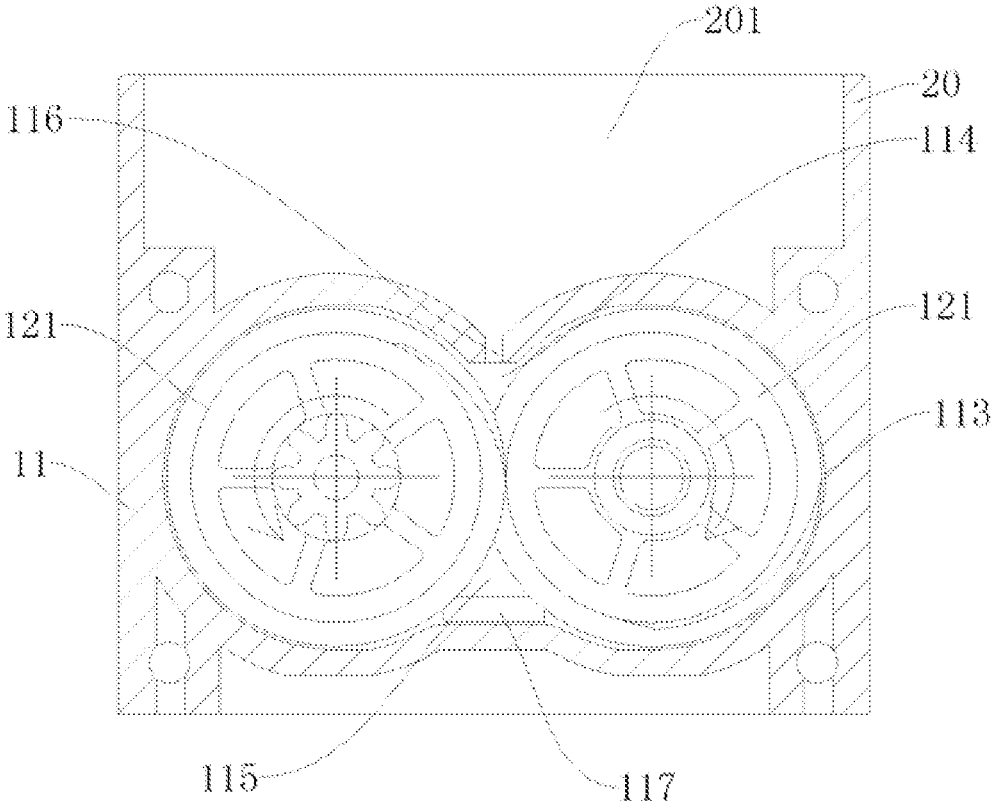
FIG. 11 is a schematic cross-sectional view of another dispensing assembly according to an embodiment of the present disclosure.

In some embodiments of the present disclosure, referring to FIG. 3 and FIG. 8, the pump body 12 includes two sub-pump bodies 121 that are rotatable and externally engaged with each other. The one-way transmission mechanism 3 is connected between one of the two sub-pump bodies 121 and the drive assembly 2. Each of the sub-pump body 121 is a gear as shown in FIG. 4 or a screw as shown in FIG. 11. Therefore, the structure is simple. As a result, it is beneficial to further improve operation reliability of the pump body 12 and ensure the dispensing precision for each dispensing operation. However, the present disclosure is not limited in this regard. The pump body 12 may also include two gear pump bodies that are rotatable and internally engaged with each other. For example, the pump body may include an inner gear and an outer gear. The outer gear is located inside the inner gear and eccentrically arranged relative to the inner gear. The driver 21 of the drive assembly 2 is connected to the outer gear. The outer gear is driven to rotate through the rotation of the driver to drive the inner gear to rotate, which can drive flow of the detergent in the pump housing 11 to generate the negative pressure at the liquid inlet 116 and the positive pressure at the liquid outlet 117. In addition, with the pressure difference, the detergent in the liquid sucking region 114 flows towards the liquid discharge region 115 and is discharged through the liquid outlet 117 for dispensing.

Figure 12:
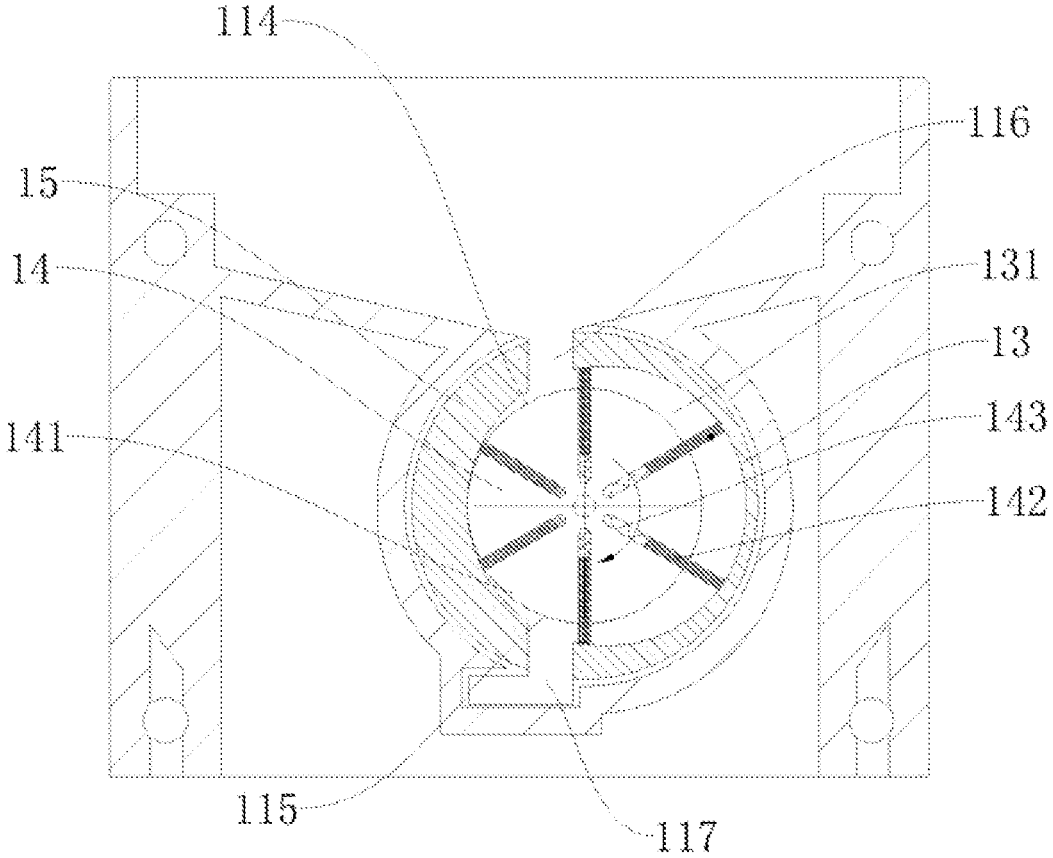
FIG. 12 is a schematic cross-sectional view of yet another dispensing assembly according to an embodiment of the present disclosure.

However, the present disclosure is not limited in the regard. As illustrated in FIG. 12, the pump body 12 may also be an impeller pump 14, and a mounting cavity 13 is formed in the pump housing 11 and has a circular cross section. The impeller pump 14 includes a wheel disc 141 and a plurality of blades 142. The one-way transmission mechanism 3 is disposed between the drive assembly 2 and the wheel disc 141. The wheel disc 141 is rotatably disposed in the mounting cavity 13. The wheel disc 141 is eccentrically arranged relative to the mounting cavity 13. A suction and discharge cavity 131 is formed between an outer peripheral wall of the wheel disc 141 and an inner peripheral wall of the mounting cavity 13. The suction and discharge cavity 131 includes the liquid sucking region 114 and the liquid discharge region 115. The plurality of blades 142 is arranged at intervals in a circumferential direction of the wheel disc 141. One end of each of the plurality of blades 142 is connected to the wheel disc 141, and the other end of each of the plurality of blades 142 elastically abuts against the inner peripheral wall of the mounting cavity 13.

For example, as illustrated in FIG. 12, the one end of each blade 142 is connected to the wheel disc 141 by a spring member 143, allowing the other end of each blade 142 to elastically abut against the inner peripheral wall of the mounting cavity 13. During the movement of the driver 21 from the first position to the second position, the driver 21 drives the one-way transmission mechanism 3 to rotate clockwise. When the one-way transmission mechanism 3 drives the impeller pump 14 to rotate clockwise, the blades 142 drive liquid in the mounting cavity 13 to rotate. Since the wheel disc 141 is eccentrically arranged, the negative pressure is generated at the liquid inlet 116 for liquid suction, and the positive pressure is generated at the liquid outlet 117 to allow the liquid to be extruded at the liquid outlet 117 to realize liquid discharge. During the movement of the driver 21 from the second position to the first position, the drive assembly 2 drives the one-way transmission mechanism 3 to move, and the one-way transmission mechanism 3 is not in a transmission engagement with the wheel disc 141 and does not drive the pump body 12 to move.

It can be understood that the control on the detergent dispensing amount can be realized by controlling the angle of the rotation of the driver 21. In addition, since the liquid suction and the liquid discharge of the dispensing pump 1 are synchronously implemented, the dispensing amount of the dispensing pump 1 would not to be limited by the volume of the dispensing pump 1. As a result, it is possible to increase the amount of the single dispensing of the dispensing device 10 and ensure the dispensing accuracy of the single dispensing. Meanwhile, since the one end of each blade 142 is connected to the wheel disc 141 and the other end of each blade 142 elastically abuts against the inner peripheral wall of the mounting cavity 13, reliable liquid inlet and discharge of the dispensing pump 1 can be ensured. In addition, when the impeller pump 14 stops operating, the other end of each blade 142 elastically abuts against the inner peripheral wall of the mounting cavity 13 to achieve sealing, which can avoid liquid leakage of the dispensing device 10.

In some embodiments of the present disclosure, referring to FIG. 12, the dispensing device 10 further includes a mounting base 15 of a cylindrical shape. The mounting base 15 is disposed in the pump housing 11 and fixed relative to the pump housing 11. The mounting cavity 13 is formed in the mounting base 15. The mounting cavity 13 is eccentrically arranged relative to the mounting base 15. It can be understood that the mounting base 15 and the pump housing 11 are separately arranged, which is advantageous to lower processing difficulty of each of the mounting base 15 and the pump housing 11 and the cost of molding.

However, the present disclosure is not limited in this regard. The mounting base 15 and the pump housing 11 may also be integrally formed. It can be understood that the integrated structure not only can ensure structure and performance stability of the mounting base 15 and the pump housing 11, but also is convenient to mold and easy to be manufactured. Further, redundant assembly parts and connection steps can be removed, which greatly improves assembly efficiency of the mounting base 15 and the pump housing 11 and ensures reliability of a connection between the mounting base 15 and the pump housing 11. Furthermore, the integrated structure is high in overall strength and stability, more convenient to assemble, and long in service life.

In some embodiments of the present disclosure, referring to FIG. 4, the one-way transmission mechanism 3 is a one-way rotary mechanism. During the movement of the driver 21 from the first position shown in FIG. 5 to the second position shown in FIG. 6, the one-way transmission mechanism 3 is driven by the drive assembly 2 to rotate in a first direction (the counterclockwise direction in FIG. 5), and engages with the pump body 12 to drive the pump body 12 to move. In addition, during the movement of the drive assembly 2 from the second position to the first position, the one-way transmission mechanism 3 rotates in a second direction opposite to the first direction. In this case, the one-way transmission mechanism 3 is not in a transmission engagement with the pump body 12, and the pump body 12 cannot rotate. It can be understood that by engaging the one-way transmission mechanism 3 with the pump body 12 or disengaging the one-way transmission mechanism 3 from the pump body 12, it is possible to control whether the driver 21 drives the pump body 12 to move. As a result, it is possible to provide a simple structure and convenient operation.

For example, referring to FIG. 4, when the dispensing pump 1 operates normally, during the rotation of the driver 21 from the first position to the second position, the one-way transmission mechanism 3 is driven by the drive assembly 2 to rotate counterclockwise. In this case, the one-way transmission mechanism 3 is engaged with one of the sub-pump bodies 121 to drive the sub-pump body 121 to rotate. Further, the sub-pump body 121 drives the other one of the sub-pump bodies 121 to rotate. In this way, the negative pressure is generated in the liquid sucking region 114, and the positive pressure is generated in the liquid discharge region 115. As a result, the detergent at the liquid inlet 116 flows to the liquid outlet 117 with the pressure difference. In addition, during the rotation of the drive assembly 2 from the second position to the first position, the one-way transmission mechanism 3 rotates clockwise. In this case, the one-way transmission mechanism 3 is not in a transmission engagement with the sub-pump body 121, and the sub-pump body 121 does not rotate. Therefore, it is possible to avoid the reverse liquid suction.

However, the present disclosure is not limited in this regard, and the rotation of the pump body 12 may be also driven by moving the driver 21 linearly. In some embodiments, during the movement of the driver 21 from the first position to the second position, the one-way transmission mechanism 3 is driven by the drive assembly 2 to rotate in the first direction. In this case, the one-way transmission mechanism 3 is engaged with one of the sub-pump bodies 121 to drive the sub-pump body 121 to rotate, and the sub-pump body 121 drives the other one of the sub-pump bodies 121 to rotate. In this way, the negative pressure is generated in the liquid sucking region 114, and the positive pressure is generated in the liquid discharge region 115. As a result, the detergent at the liquid inlet 116 flows towards the liquid outlet 117 with the pressure difference. In addition, during the movement of the driver 21 from the second position to the first position, the one-way transmission mechanism 3 rotates in the second direction opposite to the first direction. In this case, the one-way transmission mechanism 3 is not in the transmission engagement with the sub-pump body 121, and the sub-pump body 121 cannot rotate. Therefore, the reverse liquid suction can be avoided.

In some embodiments of the present disclosure, referring to FIG. 4, the pump body 12 has an engagement cavity 122. The one-way transmission mechanism 3 is at least partially located in the engagement cavity 122. In other words, the one-way transmission mechanism 3 may be partially or entirely located in the engagement cavity 122. When rotating in the first direction, the one-way transmission mechanism 3 abuts against an inner wall of the engagement cavity 122 to drive the pump body 12 to rotate. In addition, when rotating in the second direction, the one-way transmission mechanism 3 is not in a transmission engagement with the inner wall of the engagement cavity 122. Further, the expression "the one-way transmission mechanism 3 is not in a transmission engagement with the inner wall of the engagement cavity 122" may be understood that the one-way transmission mechanism 3 does not transmit a force for driving the pump body 12 to rotate to the inner wall of the engagement cavity 12. For example, the one-way transmission mechanism 3 is separated from the inner wall of the engagement cavity 122, or although the one-way transmission mechanism 3 is in contact with the engagement cavity 122, the one-way transmission mechanism 3 cannot drive the pump body 12 to rotate by means of the inner wall of the engagement cavity 12.

It can be understood that by at least partially positioning the one-way transmission mechanism 3 in the engagement cavity 122, overall space occupation of the pump body 12 and the one-way transmission mechanism 3 can be reduced. Meanwhile, and abutment or disengagement between the one-way transmission mechanism 3 and the inner wall of the engagement cavity 122 contributes to ensuring reliability of one-way transmission of the one-way transmission mechanism 3.

Figure 7:
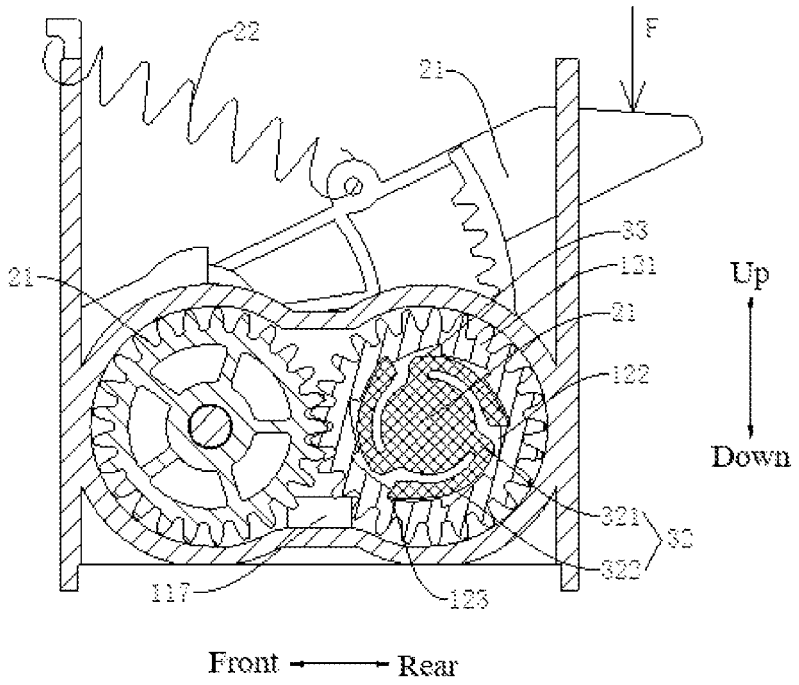
FIG. 7 is a schematic working view of the dispensing assembly shown in FIG. 1, in which a driver is located between a first position and a second position.

In some embodiments of the present disclosure, referring to FIG. 4, the inner wall of the engagement cavity 122 is provided with a first engagement tooth 123. As shown in FIG. 7, the one-way transmission mechanism 3 includes a one-way transmission wheel 33 located in the engagement cavity 122. The one-way transmission wheel 33 includes a transmission shaft 31 and a second engagement tooth 32 connected to the transmission shaft 31. At least one of the first engagement tooth 123 and the second engagement tooth 32 has elasticity. That is, either the first engagement tooth 123 or the second engagement tooth 32 has the elasticity, or both the first engagement tooth 123 and the second engagement tooth 32 have the elasticity. When the one-way transmission wheel 33 rotates in the first direction (the counterclockwise direction in FIG. 4), the second engagement tooth 32 and the first engagement tooth 123 at least abut against each other circumferentially to drive the pump body 12 to rotate. In addition, when the one-way transmission wheel 33 rotates in the second direction, the first engagement tooth 123 is disengaged from the second engagement tooth 32. It can be understood that, by forming at least one of the first engagement tooth 123 and the second engagement tooth 32 as an elastic member, when the one-way transmission wheel 33 rotates in the second direction, it is possible to ensure that the first engagement tooth 123 is disengaged from the second engagement tooth 32, which can ensure operation reliability of the one-way transmission mechanism 3.

For example, referring to FIG. 4, a plurality of first engagement teeth 123 is formed at an inner wall of an engagement cavity 122 of a sub-pump body 121 located at a rear side. A cross section of each of the plurality of first engagement teeth 123 is of a wedge shape. The plurality of first engagement teeth 123 is uniformly arranged at intervals on an inner peripheral wall of the engagement cavity 122. The one-way transmission mechanism 3 includes a one-way transmission wheel 33 located in the engagement cavity 122. The one-way transmission wheel 33 includes a transmission shaft 31 and a second engagement tooth 32 connected to the transmission shaft 31. Each of the plurality of first engagement teeth 123 is a rigid member, and the second engagement tooth 32 has elasticity. When the one-way transmission wheel 33 rotates counterclockwise, the second engagement tooth 32 and the first engagement teeth 123 abut against each other circumferentially to drive the pump body 12 to rotate. In addition, when the one-way transmission wheel 33 rotates clockwise, the first engagement teeth 123 are disengaged from the second engagement tooth 32.

In some embodiments of the present disclosure, referring to FIG. 7, the second engagement tooth 32 has elasticity and includes a connection segment 321 and an engagement segment 322. The connection segment 321 is connected to the transmission shaft 31 and extends outwards in a radial direction. The engagement segment 322 is connected to an end of the connection segment 321 away from the transmission shaft 31. The engagement segment 322 extends in a circumferential direction of the transmission shaft 31 and is spaced apart from the transmission shaft 31. It can be understood that, by designing the second engagement tooth 32 to include the connection segment 321 and the engagement segment 322, when the one-way transmission mechanism 3 rotates in the first direction, the first engagement tooth 123 and the engagement segment 322 abut against each other circumferentially, which is beneficial to ensure reliability of the abutting engagement between the first engagement tooth 123 and the second engagement tooth 32. In addition, when the one-way transmission mechanism 3 rotates in the second direction, the engagement segment 322 is deformable inwards, allowing the first engagement tooth 123 to slip relative to the second engagement tooth 32. In this way, it is possible to ensure that the first engagement tooth 123 is not in a transmission engagement with the second engagement tooth 32, which can avoid the reverse liquid suction.

For example, referring to FIG. 4 and FIG. 7, the inner wall of the engagement cavity 122 of the sub-pump body 121 located at the rear side is provided with the first engagement tooth 123 with a wedge cross-section. The second engagement tooth 32 is formed as a pawl. The second engagement tooth 32 and the transmission shaft 31 are formed as a ratchet. The engagement segment 322 is formed into a strip shape and is spaced apart from the transmission shaft 31. An upstream end of the engagement segment 322 in a counterclockwise direction is connected to the end of the connection segment 321 away from the transmission shaft 31. During the rotation of the driver 21 from the first position shown in FIG. 5 to the second position shown in FIG. 6, the transmission shaft 31 is driven by the drive assembly 2 to rotate counterclockwise. The connection segment 321 of the second engagement tooth 32 circumferentially abuts and is engaged with the first engagement tooth 123 of the sub-pump body 121 located at the rear side, to drive the sub-pump body 121 to rotate. Further, the sub-pump body 121 drives the other sub-pump body 121 to rotate. In this way, the negative pressure can be generated in the liquid sucking region 114, and the positive pressure can be generated in the liquid discharge region 115. As a result, the detergent at the liquid inlet 116 flows to the liquid outlet 117 with the pressure difference. During the rotation of the drive assembly 2 from the second position to the first position, the drive assembly 2 drives the one-way transmission wheel 33 to rotate clockwise, and the first engagement tooth 123 slips relative to the second engagement tooth 32. In this case, the one-way transmission mechanism 3 is not in the transmission engagement with the sub-pump body 121, and thus the sub-pump body 121 cannot drive the other sub-pump body 121 to rotate. In this way, it is beneficial to prevent the dispensing pump 1 from reversely sucking the detergent through the liquid outlet 117. Therefore, the accuracy of the detergent dispensing is high. Meanwhile, during the rotation of the driver 21 from the second position to the first position, the engagement segment 322 is deformed inwards. As a result, the first engagement tooth 123 slips relative to the engagement segment 322 to be not in the transmission engagement, which avoids the reverse liquid suction of the dispensing pump 1. In addition, since the one-way transmission mechanism 3 does not drive the pump body 12 to move, the resistance at which the driver 21 moves from the second position to the first position can be reduced. Therefore, the user's operation experience can be enhanced.

Figure 9:
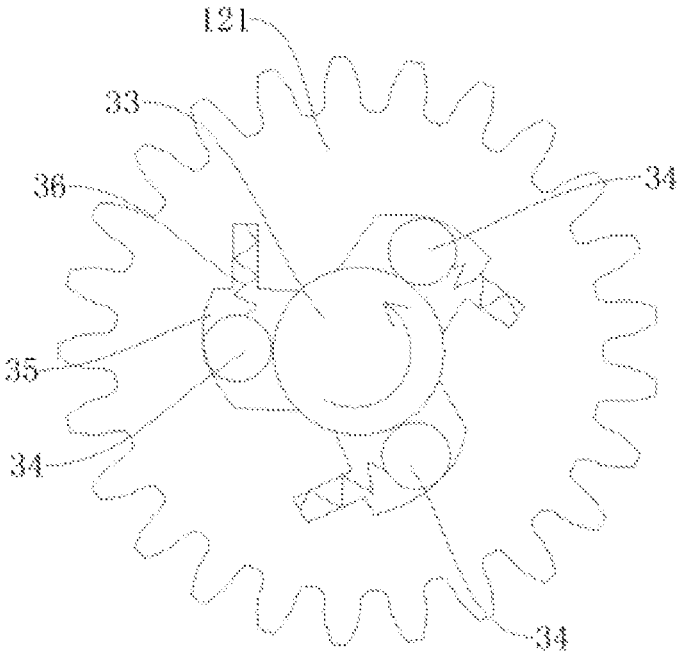
FIG. 9 is a schematic structural view of another one-way transmission wheel, clutch, and corresponding sub-pump body according to an embodiment of the present disclosure.
Figure 10:
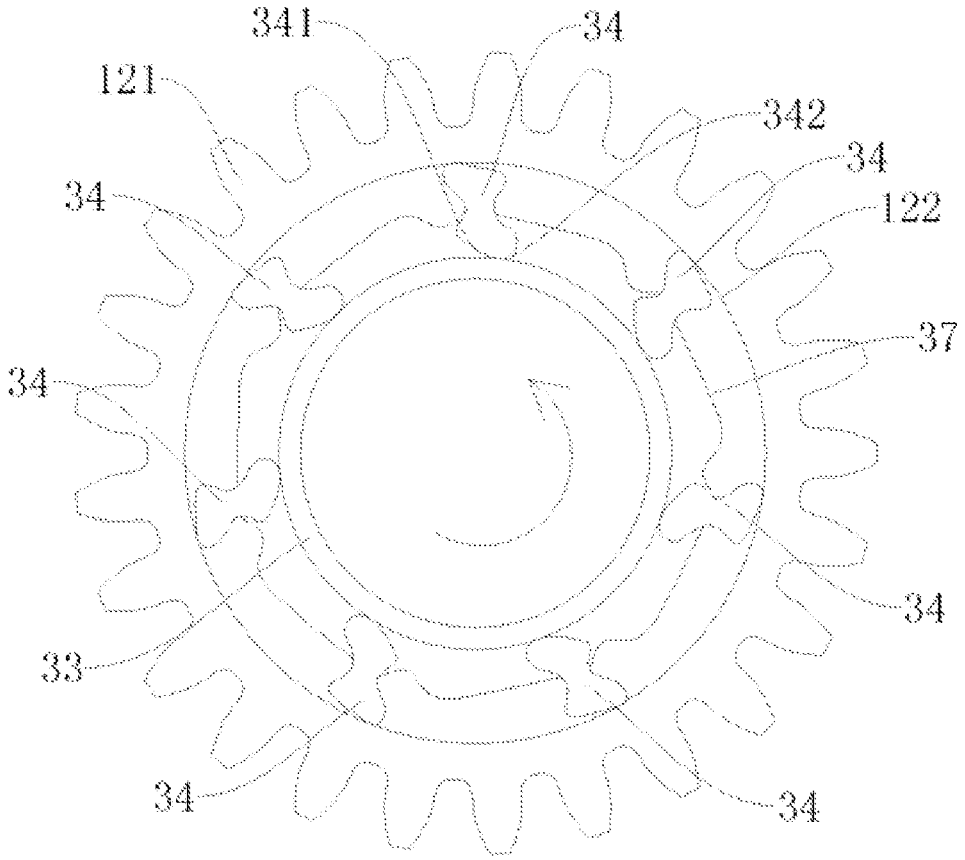
FIG. 10 is a schematic structural view of yet another one-way transmission wheel, clutch, and corresponding sub-pump body according to an embodiment of the present disclosure.

In some embodiments of the present disclosure, referring to FIG. 9 and FIG. 10, the one-way transmission mechanism 3 includes a one-way transmission wheel 33 and a clutch 34 that are located in the engagement cavity 122. The clutch 34 is movably arranged between an outer peripheral wall of the one-way transmission wheel 33 and an inner peripheral wall of the engagement cavity 122. When the one-way transmission wheel 33 rotates in the first direction (the counterclockwise direction in FIG. 9), the clutch 34 abuts against both the outer peripheral wall of the one-way transmission wheel 33 and the inner peripheral wall of the engagement cavity 122. In addition, when the one-way transmission wheel 33 rotates in the second direction, the clutch 34 is not in a transmission engagement with at least one of the outer peripheral wall of the one-way transmission wheel 33 and the inner peripheral wall of the engagement cavity 122. That is, the clutch 34 may be not in the transmission engagement with one of the outer peripheral wall of the one-way transmission wheel 33 and the inner peripheral wall of the engagement cavity 122, or the clutch 34 is not in the transmission engagement with both the outer peripheral wall of the one-way transmission wheel 33 and the inner peripheral wall of the engagement cavity 122.

In some embodiments, when the dispensing device 10 normally operates, during the movement of the driver 21 from the first position shown in FIG. 5 to the second position shown in FIG. 6, the one-way transmission wheel 33 is driven by the drive assembly 2 to rotate in the first direction, and the clutch 34 abuts against both the outer peripheral wall of the one-way transmission wheel 33 and the inner peripheral wall of the engagement cavity 122 of the pump body 12 to drive the pump body 12 to move. In this way, the negative pressure can be generated in the liquid sucking region 114, and the positive pressure can be generated in the liquid discharge region 115. Therefore, the detergent at the liquid inlet 116 flows towards the liquid discharge outlet with the pressure difference, achieving the dispensing of the detergent. In addition, during the movement of the drive assembly 2 from the second position to the first position, the one-way transmission wheel 33 rotates in the second direction opposite to the first direction, and the clutch 34 is not in the transmission engagement with at least one of the outer peripheral wall of the one-way transmission wheel 33 and the inner peripheral wall of the engagement cavity 122. In this case, the one-way transmission mechanism 3 is not in the transmission engagement with the pump body 12, and the pump body 12 cannot rotate. Therefore, it is possible to prevent the dispensing pump 1 from reversely sucking the detergent through the liquid outlet 117, and thus the detergent dispensing has high accuracy.

It can be understood that by designing the one-way transmission mechanism 3 to include the one-way transmission wheel 33 and the clutch 34, when the one-way transmission mechanism 3 rotates in the first direction, the clutch 34 abuts against both the outer peripheral wall of the one-way transmission wheel 33 and the inner peripheral wall of the engagement cavity 122. As a result, it is possible to ensure that a rotating force of the one-way transmission wheel 33 can be reliably transmitted to the pump body 12, ensuring the reliability of the rotation of the pump body 12. In addition, when the one-way transmission mechanism 3 rotates in the second direction, the clutch 34 is not in the transmission engagement with at least one of the outer peripheral wall of the one-way transmission wheel 33 and the inner peripheral wall of the engagement cavity 122. In this case, a transmission force cannot be transmitted to the pump body 12 from the one-way transmission wheel 33, and thus the pump body 12 cannot rotate.

In some embodiments of the present disclosure, referring to FIG. 9, a movement cavity 35 is formed between the outer peripheral wall of the one-way transmission wheel 33 and the inner peripheral wall of the engagement cavity 122. A radial length of the movement cavity 35 decreases in the first direction (the counterclockwise direction in FIG. 9). The clutch 34 is movably arranged in the movement cavity 35 in a circumferential direction of the one-way transmission wheel 33. The clutch 34 is elastically connected to the pump body 12 and abuts against the outer peripheral wall of the one-way transmission wheel 33. For example, as illustrated in FIG. 9, the clutch 34 is a movable pin. The clutch 34 is elastically connected to the pump body 12 through the elastic member 36 and abuts against the outer peripheral wall of the one-way transmission wheel 33. The elastic member 36 may be a spring. When rotating in the first direction (the counterclockwise direction in FIG. 9), the one-way transmission wheel 33 drives the clutch 34 to move in the first direction, allowing the clutch 34 to abut against a radial outer side wall of the movement cavity 35. In addition, when rotating in the second direction, the one-way transmission wheel 33 drives the clutch 34 to move in the second direction, allowing the clutch 34 to be not in a transmission engagement with the radial outer side wall of the movement cavity 35.

In some embodiments, when the dispensing device 10 operates normally, during the movement of the driver 21 from the first position to the second position, the one-way transmission wheel 33 is driven by the drive assembly 2 to rotate in the first direction. With a friction force between the one-way transmission wheel 33 and the clutch 34, the one-way transmission wheel 33 drives the clutch 34 to move in the first direction. In this case, the clutch 34 abuts against both the outer peripheral wall of the one-way transmission wheel 33 and the radial outer side wall of the movement cavity 35 to drive the pump body 12 to move. In this way, the negative pressure can be generated in the liquid sucking region 114, and the positive pressure can be generated in the liquid discharge region 115. As a result, the detergent at the liquid inlet 116 flows to the liquid outlet 117 with the pressure difference, realizing the dispensing of the detergent. In addition, during the movement of the drive assembly 2 from the second position to the first position, the one-way transmission wheel 33 rotates in the second direction opposite to the first direction. With the friction force between the one-way transmission wheel 33 and the clutch 34, the one-way transmission wheel 33 drives the clutch 34 to move in the second direction, allowing the clutch 34 to be not in a transmission engagement with the radial outer side wall of the movement cavity 35. In this case, the one-way transmission wheel 33 cannot drive the pump body 12 to rotate. Therefore, it is possible to prevent the dispensing pump 1 from reversely sucking the detergent through the liquid outlet 117. Therefore, the accuracy of the detergent dispensing is high.

It can be understood that the clutch 34 is movably arranged in the movement cavity 35 in the circumferential direction of the one-way transmission wheel 33, and the clutch 34 is elastically connected to the pump body 12 and abuts against the outer peripheral wall of the one-way transmission wheel 33. In this way, when the one-way transmission mechanism 3 rotates in the first direction, with the friction force between the one-way transmission wheel 33 and the clutch 34, the one-way transmission wheel 33 drives the clutch 34 to move in the first direction. In this case, the clutch 34 abuts against both the outer peripheral wall of the one-way transmission wheel 33 and the radial outer side wall of the movement cavity 35, which is beneficial to ensure that the rotating force can be reliably transmitted to the pump body 12 from the one-way transmission wheel 33 to ensure the reliability of the rotation of the pump body 12. In addition, when the one-way transmission mechanism 3 rotates in the second direction, the one-way transmission wheel 33 rotates in the second direction. In this case, with the friction force between the one-way transmission wheel 33 and the clutch 34, the one-way transmission wheel 33 can drive the clutch 34 to move in the second direction. In this case, the one-way transmission mechanism 3 is not in the transmission engagement with the pump body 12. As a result, the one-way transmission wheel 33 cannot drive the pump body 12 to rotate. Therefore, the one-way transmission can be ensured.

For example, the sub-pump body 121 at the rear side and the one-way transmission mechanism 3 shown in FIG. 3 may be replaced with the sub-pump body 121, the one-way transmission wheel 33, and the clutch 34 illustrated in FIG. 9. During the rotation of the driver 21 from the first position to the second position, the one-way transmission wheel 33 is driven by the drive assembly 2 to rotate counterclockwise. With the frictional force between the one-way transmission wheel 33 and the clutch 34, the one-way transmission wheel 33 can drive the clutch 34 to move counterclockwise. In this case, the clutch 34 abuts against both the outer peripheral wall of the one-way transmission wheel 33 and the radial outer side wall of the movement cavity 35 to drive the sub-pump body 121 to rotate. Further, the sub-pump body 121 drives the other sub-pump body 121 to rotate. In this way, the negative pressure can be generated in the liquid sucking region 114, and the positive pressure can be generated in the liquid discharge region 115. As a result, the detergent at the liquid inlet 116 flows to the liquid outlet 117 with the pressure difference. In addition, during the rotation of the driver 21 from the second position to the first position, the one-way transmission wheel 33 rotates clockwise. In addition, with the friction force between the one-way transmission wheel 33 and the clutch 34, the one-way transmission wheel 33 can drive the clutch 34 to move clockwise. In this case, the one-way transmission mechanism 3 is not in the transmission engagement with the pump body 12. As a result, the one-way transmission wheel 33 cannot drive the bump body 12 to rotate. In this process, both the two sub-pump bodies 121 cannot rotate. Therefore, the reverse liquid suction can be avoided.

In some embodiments of the present disclosure, referring to FIG. 10, the one-way transmission mechanism 3 includes a retainer 37 disposed between the outer peripheral wall of the one-way transmission wheel 33 and the inner peripheral wall of the engagement cavity 122. The clutch 34 is disposed at the retainer 37 in a swingable manner in a circumferential direction of the one-way transmission wheel 33 and abuts against the outer peripheral wall of the one-way transmission wheel 33. When rotating in the first direction, the one-way transmission wheel 33 can drive the clutch 34 to swing in the first direction (referring to a counterclockwise direction shown in FIG. 10, allowing the clutch 34 to abut against the inner peripheral wall of the engagement cavity 122. In addition, when rotating in the second direction, the one-way transmission wheel 33 can drive the clutch 34 to swing in the second direction, allowing the clutch 34 to be not in a transmission engagement with the inner peripheral wall of the engagement cavity 122.

For example, referring to FIG. 10, the clutch 34 is formed into a non-circular shape. An engagement surface of the clutch 34 with the outer peripheral wall of the one-way transmission wheel 33 has a first arc-shaped surface 341 and a second arc-shaped surface 342 connected to each other. The first arc-shaped surface 341 has a radius of curvature greater than a radius of curvature of the second arc-shaped surface 342. When rotating in the first direction, the one-way transmission wheel 33 is engaged with the second arc-shaped surface 342 to drive the clutch 34 to swing in the first direction (the counterclockwise direction in FIG. 10), allowing the clutch 34 to abut against the inner peripheral wall of the engagement cavity 122. In addition, when rotating in the second direction, the one-way transmission wheel 33 is engaged with the first arc-shaped surface 341 to drive the clutch 34 to swing in the second direction, allowing the clutch 34 to be not in the transmission engagement with the inner peripheral wall of the engagement cavity 122.

Figure 13:
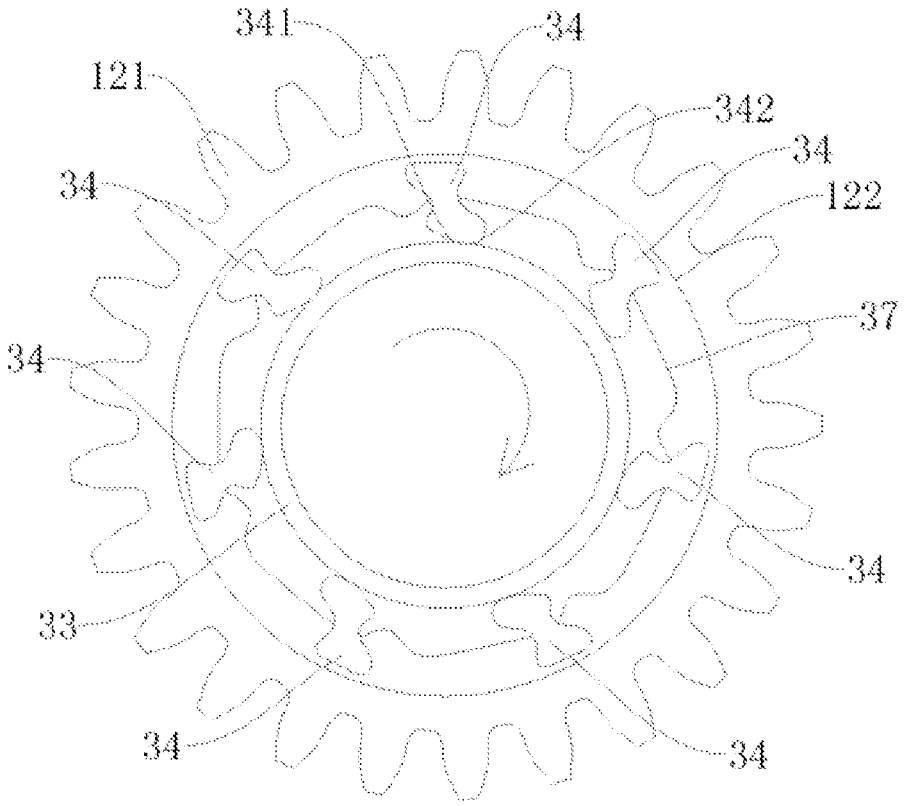
FIG. 13 is a schematic structural view of the one-way transmission wheel, clutch, and corresponding sub-pump in FIG. 10, in which the one-way transmission wheel rotates clockwise, and the clutch is inclined.

In some embodiments, when the dispensing device 10 operates normally, during the movement of the driver 21 from the first position to the second position, the one-way transmission wheel 33 is driven by the drive assembly 2 to rotate in the first direction. In this case, with the friction force between the one-way transmission wheel 33 and the clutch 34, the one-way transmission wheel 33 drives the clutch 34 to swing in the first direction, allowing the clutch 34 to be positioned vertically (as shown in FIG. 10) to be supported between the one-way transmission wheel 33 and the engagement cavity 122. In this way, the one-way transmission wheel 33 can drive the clutch 34 and the pump body 12 to rotate synchronously. As a result, the negative pressure can be generated in the liquid sucking region 114, and the positive pressure can be generated in the liquid discharge region 115. Therefore, the detergent at the liquid inlet 116 flows to the liquid outlet 117 with the pressure difference, realizing the dispensing of the detergent. In addition, during the movement of the drive assembly 2 from the second position to the first position, the one-way transmission wheel 33 rotates in the second direction opposite to the first direction. In this case, with the friction force between the one-way transmission wheel 33 and the clutch 34, the one-way transmission wheel 33 drives the clutch 34 to swing in the second direction, allowing the clutch 34 to be inclined (as shown in FIG. 13) and to be not in the transmission engagement with the inner peripheral wall of the engagement cavity 122. As a result, the one-way transmission wheel 33 cannot drive the pump body 12 to rotate. Therefore, it is beneficial to prevent the dispensing pump 1 from reversely sucking the detergent through the liquid outlet 117, and thus the accuracy of the detergent dispensing is high.

It can be understood that, by arranging the clutch 34 at the retainer 37 in a swingable manner in the circumferential direction of the one-way transmission wheel 33 and abutting the clutch 37 with the outer peripheral wall of the one-way transmission wheel 33, when the one-way transmission mechanism 3 rotates in the second direction, with the friction force between the one-way transmission wheel 33 and the clutch 34, the one-way transmission wheel 33 drives the clutch 34 to swing in the first direction, allowing the clutch 34 to be positioned vertically to be supported between the one-way transmission wheel 33 and the engagement cavity 122. In this way, the one-way transmission wheel 33 can drive the clutch 34 and the pump body 12 to rotate synchronously, which is beneficial to ensure that the rotating force can be reliably transmitted to the pump body 12 from the one-way transmission wheel 33 and ensure the reliability of the rotation of the pump body 12. In addition, when the one-way transmission mechanism 3 rotates in the second direction, the one-way transmission wheel 33 rotates in the second direction. In this case, with the friction force between the one-way transmission wheel 33 and the clutch 34, the one-way transmission wheel 33 drives the clutch 34 to swing in the second direction, allowing the clutch 34 to be inclined and to be not in the transmission engagement with the inner peripheral wall of the engagement cavity 122. In this case, the one-way transmission wheel 33 cannot drive the pump body 12 to rotate. Therefore, operation reliability is high.

For example, the sub-pump body 121 at the rear side and the one-way transmission mechanism 3 in FIG. 3 may be replaced with the sub-pump body 121, the one-way transmission wheel 33, the clutch 34, and the retainer 37 illustrated in FIG. 10. During the rotation of the driver 21 from the first position to the second position, the one-way transmission wheel 33 is driven by the drive assembly 2 to rotate counterclockwise. In this case, with the frictional force between the one-way transmission wheel 33 and the clutch 34, the one-way transmission wheel 33 drives the clutch 34 to swing counterclockwise, allowing the clutch 34 to be positioned vertically to be supported between the one-way transmission wheel 33 and the engagement cavity 122. In this case, the one-way transmission wheel 33 can drive the clutch 34 and the sub-pump body 121 to rotate synchronously, and the sub-pump body 121 drives the other sub-pump body 121 to rotate. In this way, the negative pressure can be generated in the liquid sucking region 114, and the positive pressure can be generated in the liquid discharge region 115. As a result, the detergent at the liquid inlet 116 flows to the liquid outlet 117 with the pressure difference. In addition, during the rotation of the driver 21 from the second position to the first position, the one-way transmission wheel 33 rotates clockwise. In this case, with the friction force between the one-way transmission wheel 33 and the clutch 34, the one-way transmission wheel 33 drives the clutch 34 to swing clockwise. In this case, the clutch 34 is inclined and is not in the transmission engagement with the inner peripheral wall of the engagement cavity 122. As a result, the clutch cannot drive the pump body 12 to rotate. In this process, both the sub-pump body 121 and the other sub-pump body 121 cannot rotate. Therefore, the reverse liquid suction can be avoided.

In some embodiments of the present disclosure, referring to FIG. 5 and FIG. 6, the dispensing device 10 includes a first transmission mechanism 23 in transmission connection with the driver 21. The first transmission mechanism 23 is located outside the engagement cavity 122 and connected to the one-way transmission wheel 33. It can be understood that the rotation angle of the pump body 12 may be controlled by reasonably setting a transmission ratio between the first transmission mechanism 23 and the driver 21, which is advantageous in increasing the amount of the single dispensing of the dispensing device 10 and reducing the number of dispensing times.

In some examples, the first transmission mechanism 23 and the one-way transmission wheel 33 are integrally formed. It can be understood that the integrated structure not only can ensure the structure and performance stability of the first transmission mechanism 23 and the one-way transmission wheel 33, but also is convenient to be formed and easy to be manufactured. Further, redundant assembly parts and connection steps can be removed, which can greatly enhance assembly efficiency of the first transmission mechanism 23 and the one-way transmission wheel 33, and ensure reliability of a connection between the first transmission mechanism 23 and the one-way transmission wheel 33. Further, the integrated structure is high in overall strength and stability, more convenient to be assembled, and longer in service life.

In some embodiments of the present disclosure, referring to FIG. 5, the first transmission mechanism 23 is a gear. For example, the first transmission mechanism 23 may be coaxially arranged with the corresponding sub-pump body 121. Therefore, the structure is simple. In addition, it is beneficial to ensure the reliability of the operation of the first transmission mechanism 23.

In some embodiments of the present disclosure, referring to FIG. 5, the drive assembly 2 includes a second transmission mechanism 24 connected to the driver 21. The second transmission mechanism 24 is engaged with the first transmission mechanism 23. The driver 21 is rotatably connected to the pump housing 11 between the first position and the second position. The second transmission mechanism 24 is an arc-shaped rack and extends around a rotation axis of the driver 21. It can be understood that by providing the first transmission mechanism 23 and the second transmission mechanism 24, it is advantageous to ensure a reliable transmission connection between the driver 21 and the one-way transmission mechanism 3. In addition, the rotation angle of the pump body 12 can be controlled by reasonably setting the transmission ratio between the second transmission mechanism 24 and the first transmission mechanism 23. In this way, it is beneficial to increase the amount of the single dispensing of the dispensing device 10 and reduce the number of dispensing times. Meanwhile, since the rotation trajectory of the driver 21 is an arc, by forming the second transmission mechanism 24 into the arc-shaped rack, it is beneficial to enhance reliability of driving the engagement between the first transmission mechanism 23 and the second transmission mechanism 24. Therefore, the service life can be prolonged.

For example, referring to FIG. 6, the first transmission mechanism 23 may be connected to the sub-pump body 121 located at the rear side. When the driver 21 rotates counterclockwise from the first position to the second position, the second transmission mechanism 24 drives the first transmission mechanism 23 to rotate counterclockwise. In this case, the first transmission mechanism 23 drives the one-way transmission mechanism 3 to rotate counterclockwise to drive the sub-pump body 121 located at the rear side to rotate counterclockwise. Further, the sub-pump body 121 drives a sub-pump body 121 located at a front side to rotate, to drive the liquid to flow from the liquid inlet 116 to the liquid outlet 117.

In some embodiments of the present disclosure, referring to FIG. 2 and FIG. 5, the driver 21 includes a pressing member 211 and a connection member 212. The connection member 212 is rotatably connected to the pump housing 11, and the pressing member 211 is connected to an end of the connection member 212 away from the pump housing 11. The second transmission mechanism 24 is connected to the pressing member 211. The first transmission mechanism 23 is located in an accommodation cavity 25 formed by the second transmission mechanism 24 and the connection member 212. It can be understood that, by positioning the first transmission mechanism 23 in the accommodation cavity 25 formed by the second transmission mechanism 24 and the connection member 212, it is possible to reduce foreign materials entering the engagement between the first transmission mechanism 23 and the second transmission mechanism 24, and ensure the reliability of the engagement between the second transmission mechanism 24 and the first transmission mechanism 23. For example, with reference to FIG. 6, the accommodation cavity 25 is formed as an arc-shaped cavity, and a circle center of the arc-shaped cavity is coincident a rotation center of the driver 21.

In some examples of the present disclosure, referring to FIG. 5, the pressing member 211 and the connection member 212 are integrally formed. It can be understood that the integrated structure not only can ensure structure and performance stability of the pressing member 211 and the connection member 212, but also is convenient to be formed and simple to be manufactured. Further, excessive assembly components and parts and connecting steps are removed. As a result, assembly efficiency of the pressing member 211 and the connection member 212 can be greatly improved, and connection reliability of the pressing member 211 and the connection member 212 can be ensured. Further, the integrated structure is high in overall strength and stability, more convenient to assemble, and longer in service life.

However, the present disclosure is not limited in this regard. In other examples, the driver 21 may also be movable. That is, the driver 21 has a straight movement trajectory. For example, the driver 21 is movably disposed at the pump housing 11 and is movable between a third position and a fourth position. The third position is above the fourth position. The first transmission mechanism 23 is a gear and is connected to the pump body 12 through the one-way transmission mechanism 3. The second transmission mechanism 24 is disposed at the driver 21 and is a rack extending in a movement direction of the driver 21. When the dispensing device 10 operates normally, during a movement of the driver 21 from the third position to the fourth position, the second transmission mechanism 24 drives the first transmission mechanism 23 to rotate, and the one-way transmission mechanism 3 drives the pump body 12 to move to drive the liquid to flow to the liquid outlet 117 from the liquid inlet 116. During a movement of the driver 21 from the fourth position to the third position, the second transmission mechanism 24 drives the first transmission mechanism 23 to rotate, and the one-way transmission mechanism 3 is not in the transmission engagement with the pump body 12, and does not drive the pump body 12 to move.

In some embodiments of the present disclosure, referring to FIG. 5, the drive assembly 2 further includes an elastic restoration member 22. The driver 21 is movable from the first position to the second position with an external force exerted by a user. In addition, the elastic restoration member 22 is configured to drive the driver 21 to restore to the first position from the second position when the external force exerted by the user is removed. Therefore, after the driver 21 is operated to move from the first position to the second position, it is not necessary to manually restore the driver 21 to the first position, which further facilitates the user operation. In addition, compared with the traditional manual dispensing device, since the liquid sucking region 114 and the liquid discharge region 115 of the dispensing pump 1 are located in different regions, when the dispensing device 10 operates normally, the liquid suction at the liquid inlet 116 and the liquid discharge at the liquid outlet 117 of the dispensing pump 1 are synchronously implemented. Therefore, the elastic restoration member 22 does not need to have a large restoring force. In addition, dispensing can be realized without large force when the drive assembly 2 is pressed by the user, which is conducive to improving user's operating comfort.

However, the present disclosure is not limited in this regard. The drive assembly 2 may also not include the elastic restoration member 22. After the driver 21 is driven by the user to move from the first position to the second position, the driver 21 may be manually operated to allow the driver 21 to be restored from the second position to the first position.

In some embodiments of the present disclosure, referring to FIG. 5, the elastic restoration member 22 has an end connected to the driver 21 and another end connected to the pump housing 11. For example, as illustrated in FIG. 5, the elastic restoration member 22 is a spring. The one end of the elastic restoration member 22 is connected to an upper part of the driver 21, and the other end of the elastic restoration member 22 is connected to an outer side wall of a storage box 20. It can be understood that, with reference to FIG. 5, when the driver 215 is subjected to a driving force F, the elastic restoration member 22 undergoes tensile deformation, as shown in FIG. 6. When the driving force F is removed, the elastic restoration member 22 restores its deformation to drive the driver 21 back to its original position. Therefore, the structure is simple, and the operation is convenient.

Referring to FIG. 1 and FIG. 2, the dispensing assembly 100 according to the embodiments of the present disclosure includes a dispensing device 10 and a storage box 20 for storing detergent. The dispensing device 10 is the dispensing device 10 according to the above embodiments of the present disclosure. The storage box 20 has a storage cavity 201 in communication with the liquid inlet 116. For example, referring to FIG. 8, the storage box 20 is located above the dispensing device 10. Therefore, the detergent in the storage box 20 can flow to the liquid inlet 116 by means of gravity.

With the dispensing assembly 100 according to the embodiments of the present disclosure, by providing the dispensing device 10 according to the above embodiments of the present disclosure, during the movement of the driver 21 from the second position to the first position, the drive assembly 2 drives the one-way transmission mechanism 3 to move, and the one-way transmission mechanism 3 does not drive the pump body 12 to move. Therefore, it is beneficial to prevent the dispensing pump 1 from reversely sucking the detergent through the liquid outlet 117. Therefore, the accuracy of detergent dispensing can be ensured. Meanwhile, during the movement of the driver 21 from the second position to the first position, since the one-way transmission mechanism 3 does not drive the pump body 12 to move, it is possible to lower the resistance at which the driver 21 moves from the second position to the first position. Therefore, the user's operation experience can be enhanced.

In some embodiments of the present disclosure, referring to FIG. 1 and FIG. 2, the storage box 20 is disposed at the pump housing 11. For example, the storage box 20 is located above the pump housing 11 and connected to the pump housing 11. Therefore, it is beneficial to reduce overall space occupation of the storage box 20 and the pump housing 11 and realize miniaturization of the dispensing assembly 100. In addition, in other embodiments, the storage box 20 may be connected to the pump housing 11 through a connection pipe. In this way, the connection is easy, and the storage box 20 and the pump housing 11 may be arranged separately. As a result, installation flexibility of the dispensing assembly 100 can be improved.

In some embodiments of the present disclosure, referring to FIG. 1 and FIG. 2, the storage box 20 is disposed at the pump housing 11. Further, the storage box 20 is detachably connected to the pump housing 11. It can be understood that since the storage box 20 is detachably connected to the pump housing 11, replacement or maintenance of both the storage box 20 and the pump housing 11 are easily, and maintenance cost can be lowered.

For example, in an example, referring to FIG. 1 and FIG. 2, the pump housing 11 includes a housing member 111 and an end cover 112. The housing member 111 and the storage box 20 are integrally formed, and the end cover 112 is detachably disposed at an open end of an integrated member formed by the housing member 111 and the storage box 20 through a threaded fastener. It can be understood that the integrated structure not only can ensure structure and performance stability of the housing member 111 and the storage box 20, but also is convenient to be formed and easy to be manufactured. In addition, redundant assembly components and parts and connecting steps are removed. As a result, assembly efficiency of the housing member 111 and the storage box 20 can be greatly enhanced. Meanwhile, the threaded fastener has the advantages of being simple in structure and easy to be assembled. Therefore, a tight connection between the end cover 112 and the integrated member formed by the housing member 111 and the storage box 20 can be achieved through the threaded fastener. In addition, it is possible to lower the cost while ensuring a connection strength between the end cover 112 and the integrated member formed by the housing member 111 and the storage box 20. In some embodiments, the threaded fastener may be a screw, a bolt, or a stud.

In other embodiments, the storage box 20 and the pump housing 11 are integrally formed. It can be understood that the integrated structure not only can ensure structure and performance stability of the storage box 20 and the pump housing 11, but also is convenient to be formed and easy to be manufactured. In addition, redundant assembly components and parts and connecting steps are removed. As a result, assembly efficiency of the storage box 20 and the pump housing 11 can be greatly improved, and reliability of a connection between the storage box 20 and the pump housing 1111 can be ensured. In addition, the integrated structure is high in overall strength and stability, more convenient to be assembled, and longer in service life.

As illustrated in FIG. 8, a washing device 1000 according to embodiments of the present disclosure includes the dispensing assembly 100 according to the above embodiments of the present disclosure. The washing device 1000 may be a washing device 1000 such as a washing machine, a dishwasher, or a sink.

For example, as illustrated in FIG. 8, the washing device 1000 is a washing machine. The washing device 1000 includes a dispensing assembly 100, a water inlet valve 200, a mixing chamber 300, and a washing tub 400. The dispensing assembly 100 is located above the mixing chamber 300 and in communication with the mixing chamber 300. The water inlet valve 200 is in communication with the mixing chamber 300 to control water supply to the mixing chamber 300. The washing tub 400 is located below an outlet of the mixing chamber 300, and the detergent and water flow may be mixed in the mixing chamber 300 and then flow to the washing tub 400 for washing. It can be understood that when the water flow flows through the detergent in the mixing chamber 300, diluting and mixing can be achieved, which is more conducive to washing. However, the present disclosure is not limited in this regard. The dispensing assembly 100 may also directly dispense the detergent into the washing tub 400.

With the washing device 1000 according to the embodiments of the present disclosure, by providing the dispensing assembly 100 according to the above embodiments of the present disclosure, during the movement of the driver 21 from the second position to the first position, the drive assembly 2 drives the one-way transmission mechanism 3 to move, and the one-way transmission mechanism 3 does not drive the pump body 12 to move. Therefore, it is beneficial to prevent the dispensing pump 1 from reversely sucking the detergent through the liquid outlet 117, to ensure the accuracy of detergent dispensing. Meanwhile, during the movement of the driver 21 from the second position to the first position, since the one-way transmission mechanism 3 does not drive the pump body 12 to move, it is possible to reduce the resistance at which the driver 21 moves from the second position to the first position. Therefore, the user's operation experience can be enhanced, and overall performance of the washing device 1000 can be improved.

Specific structures of the dispensing device 10, the dispensing assembly 100, and the washing device 1000 of the present disclosure will be described in detail below with reference to the accompanying drawings. It can be understood that the following description is intended to explain the present disclosure, rather than being used as a limitation on the present disclosure.

Referring to FIGS. 1 to 8, for the washing device 1000 according to the embodiments of the present disclosure, the washing device 1000 is specifically the washing machine. The washing device 1000 includes a dispensing assembly 100, a water inlet valve 200, a mixing chamber 300, and a washing tub 400.

Referring to FIG. 8, the dispensing assembly 100 is located above the mixing chamber 300 and in communication with the mixing chamber 300. The water inlet valve 200 is in communication with the mixing chamber 300 to control water supply to the mixing chamber 300. The washing tub 400 is located below an outlet of the mixing chamber 300. After being mixed in the mixing chamber 300, the detergent and water can flow to the washing tub 400 for washing. It can be understood that when the water flows through the detergent in the mixing chamber 300, diluting and mixing can be achieved, which is more conducive to washing.

Referring to FIG. 1 and FIG. 2, the dispensing assembly 100 includes a dispensing device 10 and a storage box 20 for storing the detergent. The storage box 20 is in communication with the dispensing device 10 to supply the detergent to the dispensing device 10.

Referring to FIG. 3 to FIG. 5, the dispensing device 10 includes a dispensing pump 1, a one-way transmission mechanism 3, and a drive assembly 2. The dispensing pump 1 includes a pump housing 11 and a pump body 12. In some embodiments, the pump housing 11 includes a housing member 111 and an end cover 112. The housing member 111 and the storage box 20 are integrally formed, and the end cover 112 is detachably disposed at an open end of an integrated member formed by the housing member 111 and the storage box 20 by means of a threaded fastener.

Referring to FIG. 5, the pump body 12 is located in the pump housing 11 and includes two sub-pump bodies 121 that are rotatable and externally engaged with each other. The two sub-pump bodies 121 are arranged in a front-rear direction. Each of the two sub-pump bodies 121 is a gear. The two sub-pump bodies 121 enable the pump housing 11 to form a liquid sucking region 114 and a liquid discharge region 115 that are arranged in an up-down direction. The pump housing 11 has a liquid inlet 116 corresponding to the liquid sucking region 114 and a liquid outlet 117 corresponding to the liquid discharge region 115. The liquid inlet 116 is in communication with the storage box 20, and the liquid outlet 117 is in communication with a top of the mixing chamber 300. In some embodiments, the liquid inlet 116 is located above an engagement between the two sub-pump bodies 121, and the liquid outlet 117 is located below the engagement between the two sub-pump bodies 121.

In some embodiments, an engagement cavity 122 is formed in the sub-pump body 121 located at the rear side. The one-way transmission mechanism 3 is located in the engagement cavity 122 and is a rotary transmission mechanism. The inner wall of the engagement cavity 122 is provided with a plurality of first engagement teeth 123. A cross section of each of the first engagement teeth 123 is of a wedge shape. The one-way transmission mechanism 3 includes a one-way transmission wheel 33 located in the engagement cavity 122. The one-way transmission wheel 33 includes a transmission shaft 31 and a second engagement tooth 32 connected to the transmission shaft 31. The second engagement tooth 32 has elasticity and is adapted to be engaged with the first engagement teeth 123. The second engagement tooth 32 includes a connection segment 321 and an engagement segment 322. The connection segment 321 is connected to the transmission shaft 31 and extends outwards in the radial direction. The engagement segment 322 is connected to an end of the connection segment 321 away from the transmission shaft 31. Further, the engagement segment 322 extends in the circumferential direction of the transmission shaft 31 and is spaced apart from the transmission shaft 31.

Referring to FIG. 1 to FIG. 3, the drive assembly 2 is located at a left side of the dispensing pump 1. Further, the drive assembly 2 includes a driver 21, a first transmission mechanism 23, a second transmission mechanism 24, and an elastic restoration member 22. The driver 21 is rotatably connected to the pump housing 11 between a first position and a second position. Further, the driver 21 includes a pressing member 211 and a connection member 212. The connection member 212 is rotatably connected to the pump housing 11, and the pressing member 211 is connected to an end of the connection member 212 away from the pump housing 11.

Referring to FIG. 4 and FIG. 5, the first transmission mechanism 23 is located outside the engagement cavity 122 and is fixedly connected to the transmission shaft 31. The first transmission mechanism 23 is a gear. The second transmission mechanism 24 is connected to the pressing member 211. Further, the second transmission mechanism 24 is an arc-shaped rack and extends around the rotation axis of the driver 21. An accommodation cavity 25 is formed by the second transmission mechanism 24 and the connection member 212. The first transmission mechanism 23 is located in the accommodation cavity 25. The first transmission mechanism 23 and the second transmission mechanism 24 are engaged with each other. The elastic restoration member 22 is a spring. Further, the elastic restoration member 22 is located above the driver 21 and connected between the pressing member 211 and the pump housing 11.

Referring to FIG. 6, during a movement of the driver 21 from the first position to the second position, a second transmission mechanism 24 drives a first transmission mechanism 23 to rotate, and the first transmission mechanism 23 in turn drives the one-way transmission wheel 33 to rotate. In this case, the one-way transmission wheel 33 drives the sub-pump body 121 located at the rear side to rotate, and the sub-pump body 121 is engaged with the other sub-pump body 121 to drive the other sub-pump body 121 to rotate, driving the liquid to flow to the liquid outlet 117 from the liquid inlet 116. During a movement of the driver 21 from the second position to the first position, the second transmission mechanism 24 drives the first transmission mechanism 23 to rotate, the first transmission mechanism 23 in turn drives the one-way transmission wheel 33 to rotate, and the one-way transmission wheel 33 does not drive the sub-pump body 121 located at the rear side to rotate.

In some embodiments, in a normal operation state of the dispensing device 10, referring to FIG. 4, when the driver 21 is pressed with a driving force F, the driver 21 is driven to rotate from the first position to the second position. The driver 21 rotates counterclockwise around a rotation axis L, and a rotation trajectory of the driver 21 is an arc. In this process, the second transmission mechanism 24 drives the first transmission mechanism 23 to rotate counterclockwise, and the first transmission mechanism 23 then drives the one-way transmission wheel 33 connected to the first transmission mechanism 23 to rotate counterclockwise. In this case, the one-way transmission wheel 33 drives the corresponding sub-pump body 121 to rotate, and the sub-pump body 121 is engaged with the other sub-pump body 121 to drive the other sub-pump body 121 to rotate. In this way, the negative pressure is generated in the liquid sucking region 114, and the positive pressure is generated in the liquid discharge region 115. As a result, the detergent at the liquid inlet 116 flows to the liquid discharge region 115 with the pressure difference, and is discharged through the liquid outlet 117, to realize the detergent dispensing. Meanwhile, during this process, the elastic restoration member 22 is pulled.

It can be understood that, with reference to FIG. 5, the liquid sucking region 114 and the liquid discharge region 115 of the dispensing pump 1 according to the embodiments of the present disclosure are located in different regions. When the dispensing device 10 operates normally, the liquid suction at the liquid inlet 116 and the liquid discharge at the liquid outlet 117 of the dispensing pump 1 are synchronously implemented. Therefore, a great restoration force is not required, and only a small force is required to implement the dispensing, which can greatly improve the comfort of user operation. Meanwhile, since the transmission ratio between the first transmission mechanism 23 and the second transmission mechanism 24 and the rotation angle of the driver 21 are constant, rotation revolutions of the corresponding sub-pump body 121 is constant. Therefore, the amount of the single dispensing of the dispensing device 10 is constant, and the user can obtain an accurate total dispensing amount by controlling the number of dispensing times. In addition, in a case of a predetermined volume of the dispensing device 10, the dispensing device 10 according to the embodiments of the present disclosure has a great single dispensing amount, which facilitates reducing a number of dispensing operations performed by the user and is beneficial to further enhance the user experience.

When a user's driving force is removed, with the elastic restoration member 22, the driver 21 automatically restores to the first position clockwise from the second position. During this process, the second transmission mechanism 24 drives the first transmission mechanism 23 to rotate clockwise, and the first transmission mechanism 23 then drives the one-way transmission wheel 33 to rotate clockwise to allow the engagement segment 322 to be deformed inwards. In this case, the engagement segment 322 slips relative to the first engagement teeth 123 to unable power to be transmitted to the corresponding sub-pump body 121 from the engagement segment 322. In this way, the one-way transmission mechanism 3 can provide a one-way transmission effect, and the reverse liquid suction of the dispensing pump 1 can be avoided. Meanwhile, since the one-way transmission mechanism 3 does not drive the pump body 12 to move, it is advantageous to reduce the resistance at which the driver 21 moves from the second position to the first position. Therefore, it is possible to efficaciously reduce the restoring force of the elastic restoration member 22. Therefore, the restoration time can be shortened. Therefore, the user's operation experience can be further enhanced.

Other arrangements and operations of the washing device 1000 according to the embodiments of the present disclosure are known to those of ordinary skill in the art, and the description thereof in detail will be omitted herein.

In the description of the present disclosure, it is to be understood that, terms such as "center," "longitudinal," "lateral," "length," "width," "thickness," "over," "below," "front," "back," "left," "right," "vertical," "horizontal," "top," "bottom," "in," "out," "clockwise," "counterclockwise," "axial," "radial," "circumferential" etc., is based on the orientation or position relationship shown in the drawings, and is only for the convenience of describing the present disclosure and simplifying the description, rather than indicating or implying that the associated device or element must have a specific orientation, or be constructed and operated in a specific orientation, and therefore cannot be understood as a limitation to the present disclosure.

In addition, the term "first" or "second" is merely for descriptive purposes, rather than indicating or implying relative importance or implicitly indicating the number of indicated technical features. Therefore, the features associated with "first" or "second" can explicitly or implicitly include at least one of the features. In the description of the embodiments of the present disclosure, "plurality" means at least two, unless otherwise specifically defined.

In the present disclosure, unless otherwise clearly specified and limited, terms such as "installed," "connected," "coupled," "fixed" and the like should be understood in a broad sense. For example, it may be a fixed connection or a detachable connection or connection as one piece; mechanical connection or electrical connection or communication; direct connection or indirect connection through an intermediate; internal communication of two components or the interaction relationship between two components. For those of ordinary skill in the art, the specific meaning of the above-mentioned terms in the present disclosure can be understood according to specific circumstances.

In the present disclosure, unless expressly stipulated and defined otherwise, the first feature "on" or "under" the second feature may mean that the first feature is in direct contact with the second feature, or the first and second features are in indirect contact through an intermediate. In addition, the first feature "above" the second feature may mean that the first feature is directly above or obliquely above the second feature, or simply mean that the level of the first feature is higher than that of the second feature. The first feature "below" the second feature may mean that the first feature is directly below or obliquely below the second feature, or simply mean that the level of the first feature is smaller than that of the second feature.

Throughout this specification, description with reference to the phrase "an embodiment," "some embodiments," "an example," "a specific example," or "some examples" means that a particular feature, structure, material, or characteristic described in connection with the embodiment or example is included in at least one embodiment or example of the present disclosure. The appearances of the above phrases in various places throughout this specification are not necessarily referring to the same embodiment or example of the present disclosure. Furthermore, the particular features, structures, materials, or characteristics described may be combined in any suitable manner in one or more embodiments or examples. In addition, different embodiments or examples and features of different embodiments or examples described in the specification may be combined by those skilled in the art so long as no contradiction exits.

Although the embodiments of the present disclosure have been shown and described above, it can be understood that the above-mentioned embodiments are exemplary and should not be construed as limiting the present disclosure. Those of ordinary skill in the art can make changes, modifications, substitutions and modifications to the above-mentioned embodiments within the scope of the present disclosure.

What is claimed is:

1. A dispensing device for dispensing detergent comprising:

a dispensing pump including a pump housing and a pump body, the pump housing having a liquid inlet and a liquid outlet;

a drive assembly including a driver movable between a first position and a second position; and a one-way transmission mechanism located between the drive assembly and the pump body;

wherein:

during a movement of the driver from the first position to the second position, the drive assembly drives the one-way transmission mechanism to move, and the one-way transmission mechanism drives the pump body to move, to suck the detergent through the liquid inlet and discharge the detergent through the liquid outlet; and during a movement of the driver from the second position to the first position, the drive assembly drives the one-way transmission mechanism to move, and the one-way transmission mechanism does not drive the pump body to move.

2. The dispensing device according to claim 1, wherein the pump body is rotatably disposed in the pump housing to form a liquid sucking region and a liquid discharge region in the pump housing, the liquid inlet corresponding to the liquid sucking region, and the liquid outlet corresponding to the liquid discharge region.

3. The dispensing device according to claim 1, wherein:

the one-way transmission mechanism is a one-way rotary mechanism;

during the movement of the driver from the first position to the second position, the one-way transmission mechanism is driven by the drive assembly to rotate in a first direction, and is engaged with the pump body to drive the pump body to move; and during the movement of the driver from the second position to the first position, the one-way transmission mechanism rotates in a second direction opposite to the first direction and is disengaged from the pump body.

4. The dispensing device according to claim 3, wherein:

the pump body has an engagement cavity, the one-way transmission mechanism being at least partially located in the engagement cavity;

when rotating in the first direction, the one-way transmission mechanism abuts against an inner wall of the engagement cavity to drive the pump body to rotate; and when rotating in the second direction, the one-way transmission mechanism is not in a transmission engagement with the inner wall of the engagement cavity.

5. The dispensing device according to claim 4, wherein:

the inner wall of the engagement cavity is provided with a first engagement tooth;

the one-way transmission mechanism includes a one-way transmission wheel located in the engagement cavity, the one-way transmission wheel including a transmission shaft and a second engagement tooth connected to the transmission shaft, and at least one of the first engagement tooth and the second engagement tooth having elasticity;

when the one-way transmission wheel rotates in the first direction, the second engagement tooth and the first engagement tooth at least abut against each other circumferentially to drive the pump body to rotate; and when the one-way transmission wheel rotates in the second direction, the first engagement tooth is disengaged from the second engagement tooth.

6. The dispensing device according to claim 5, wherein:

the second engagement tooth has elasticity and includes a connection segment and an engagement segment;

the connection segment is connected to the transmission shaft and extends outwards in a radial direction; and the engagement segment is connected to an end of the connection segment away from the transmission shaft, and extends in a circumferential direction of the transmission shaft and is spaced apart from the transmission shaft.

7. The dispensing device according to claim 3, wherein:

the one-way transmission mechanism includes a one-way transmission wheel and a clutch that are located in an engagement cavity, the clutch being movably arranged between an outer peripheral wall of the one-way transmission wheel and an inner peripheral wall of the engagement cavity;

when the one-way transmission wheel rotates in the first direction, the clutch abuts against each of the outer peripheral wall of the one-way transmission wheel and the inner peripheral wall of the engagement cavity; and when the one-way transmission wheel rotates in the second direction, the clutch is not in a transmission engagement with at least one of the outer peripheral wall of the one-way transmission wheel and the inner peripheral wall of the engagement cavity.

8. The dispensing device according to claim 7, wherein:

a movement cavity is formed between the outer peripheral wall of the one-way transmission wheel and the inner peripheral wall of the engagement cavity, the movement cavity having a radial length decreasing in the first direction, the clutch being movably arranged in the movement cavity in a circumferential direction of the one-way transmission wheel, and the clutch being elastically connected to the pump body and abutting against the outer peripheral wall of the one-way transmission wheel;

when rotating in the first direction, the one-way transmission wheel drives the clutch to move in the first direction to allow the clutch to abut against a radial outer side wall of the movement cavity; and when rotating in the second direction, the one-way transmission wheel drives the clutch to move in the second direction to allow the clutch to be not in a transmission engagement with the radial outer side wall of the movement cavity.

9. The dispensing device according to claim 7, wherein:

the one-way transmission mechanism includes a retainer disposed between the outer peripheral wall of the one-way transmission wheel and the inner peripheral wall of the engagement cavity, the clutch being disposed at the retainer in a swingable manner in a circumferential direction of the one-way transmission wheel and abuts against the outer peripheral wall of the one-way transmission wheel;

when rotating in the first direction, the one-way transmission wheel drives the clutch to swing in the first direction to allow the clutch to abut against the inner peripheral wall of the engagement cavity; and when rotating in the second direction, the one-way transmission wheel drives the clutch to swing in the second direction to allow the clutch to be not in a transmission engagement with the inner peripheral wall of the engagement cavity.

10. The dispensing device according to claim 3, further comprising:

a first transmission mechanism in transmission connection with the driver, the first transmission mechanism being located outside an engagement cavity of the pump body and connected to a one-way transmission wheel of the one-way transmission mechanism.

11. The dispensing device according to claim 10, wherein the first transmission mechanism is a gear.

12. The dispensing device according to claim 10, wherein:

the drive assembly includes a second transmission mechanism connected to the driver and engaged with the first transmission mechanism; and the driver is rotatably connected to the pump housing between the first position and the second position, and the second transmission mechanism is an arc-shaped rack and extends around a rotation axis of the driver.

13. The dispensing device according to claim 12, wherein:

the driver includes:

a connection member rotatably connected to the pump housing; and a pressing member connected to an end of the connection member away from the pump housing;

the second transmission mechanism is connected to the pressing member; and the first transmission mechanism is located in an accommodation cavity formed by the second transmission mechanism and the connection member.

14. The dispensing device according to claim 1, wherein:

the drive assembly further includes an elastic restoration member;

the driver is configured to move from the first position to the second position with an external force exerted by a user; and the elastic restoration member is configured to drive the driver to restore to the first position from the second position when the external force exerted by the user is removed.

15. A dispensing assembly comprising:

the dispensing device according to claim 1; and a storage box for storing the detergent, the storage box having a storage cavity in communication with the liquid inlet.

16. The dispensing assembly according to claim 15, wherein the storage box is disposed at the pump housing, or is connected to the pump housing through a connection pipe.

17. The dispensing assembly according to claim 15, wherein:

the storage box is disposed at the pump housing; and the storage box is detachably connected to the pump housing, or the storage box and the pump housing are integrally formed.

18. A washing device comprising the dispensing assembly according to claim 15.

* * * * *